US008586898B2

(12) United States Patent
Novak

(10) Patent No.: US 8,586,898 B2
(45) Date of Patent: Nov. 19, 2013

(54) METHOD AND APPARATUS FOR DUAL APPLICATOR MICROWAVE DESIGN

(76) Inventor: John F. Novak, Fredericktown, OH (US)

( * ) Notice: Subject to any disclaimer, the term of this patent is extended or adjusted under 35 U.S.C. 154(b) by 0 days.

(21) Appl. No.: 13/106,470

(22) Filed: May 12, 2011

(65) Prior Publication Data

US 2012/0125920 A1 May 24, 2012

Related U.S. Application Data

(60) Provisional application No. 61/333,895, filed on May 12, 2010.

(51) Int. Cl.
*H05B 6/70* (2006.01)
*H05B 6/78* (2006.01)
*H05B 6/64* (2006.01)

(52) U.S. Cl.
USPC ..... 219/690; 219/700; 219/684; 219/678; 219/686; 373/138; 373/140

(58) Field of Classification Search
USPC ..... 219/686, 684, 678, 698
See application file for complete search history.

(56) References Cited

U.S. PATENT DOCUMENTS

| | | | | |
|---|---|---|---|---|
| 4,631,380 | A * | 12/1986 | Tran | 219/697 |
| 4,725,797 | A * | 2/1988 | Thompson et al. | 333/212 |
| 6,192,318 | B1 * | 2/2001 | Yogo et al. | 702/65 |
| 6,618,957 | B2 * | 9/2003 | Novak et al. | 34/264 |
| 6,864,757 | B2 | 3/2005 | DuToit et al. | |
| 6,872,927 | B2 * | 3/2005 | Geisler et al. | 219/700 |
| 2004/0005242 | A1 * | 1/2004 | Koulik et al. | 422/22 |
| 2007/0102279 | A1 * | 5/2007 | Novak | 204/157.6 |
| 2007/0131591 | A1 | 6/2007 | Pringle | |
| 2007/0209924 | A1 | 9/2007 | Vainer | |
| 2008/0063578 | A1 | 3/2008 | Molohon et al. | |
| 2009/0056695 | A1 * | 3/2009 | Cosgrove | 126/25 R |
| 2009/0295509 | A1 * | 12/2009 | Master et al. | 333/219.1 |
| 2010/0230270 | A1 * | 9/2010 | Lee et al. | 204/155 |

FOREIGN PATENT DOCUMENTS

| | | | |
|---|---|---|---|
| JP | 2007267083 | A | 10/2007 |
| JP | 2008284529 | A | 3/2008 |

OTHER PUBLICATIONS

International Search Report for application PCT/US2011/036284.
Written Opinion of the International Search Authority for application PCT/US2011/036284.
International Preliminary Report on Patentability for application PCT/US2011/036284 dated Nov. 22, 2012.

* cited by examiner

*Primary Examiner* — Henry Yuen
*Assistant Examiner* — Diallo I Duniver

(57) ABSTRACT

The invention described herein pertains generally to a more efficient and cost-effective method and apparatus for: (1) coupling of microwave energy from a microwave generator or plurality of microwave generators into an integral set of applicators; (2) extraction and separation of organic compounds from a mixture of organic and inorganic compounds; and (3) recovery and conversion of the organic compounds to gaseous and liquid fuels. The apparatus described in this invention result in improved microwave absorption within the mixture flowing through the applicators by increasing residence time within the applicators, resulting in a higher temperature within the material. The higher temperature lowers the viscosity of the solution, but also provides a limited reduction of the combination of complex chain and aromatic organic compounds to allow recovery of syngas and fuel oil.

10 Claims, 6 Drawing Sheets

METHOD AND APPARATUS FOR DUAL APPLICATOR MICROWAVE DESIGN

CROSS-REFERENCE TO RELATED APPLICATIONS

This application claims priority to provisional U.S. Patent Application Ser. No. 61/333,895 filed 12 May 2010, the provisional application hereinby incorporated by reference.

TECHNICAL FIELD

This invention pertains primarily to an improved, non-pyrolytic method and apparatus for: (1) coupling of the microwave energy to the applicator; (2) matching the applied microwave energy from the microwave generator(s) to the volume of material within the applicator(s); (3) diffusion of high power density microwave energy throughout the applicator; (4) transfer of energy volumetrically to applicator material through improved microwave absorption and thermally conductive techniques; and (5) reduced energy consumption.

BACKGROUND OF THE INVENTION

The application of microwave energy to achieve drying, breakdown of organic materials, and organic synthesis is well known. However, the prior art has failed to achieve commercial acceptance in the industrial market due to a variety of reasons. Problems previously encountered by others during scale up from a laboratory unit to a prototype, pilot plant, or commercial size plant, limited the acceptance of microwave-based applications for large-scale implementation.

Also, considerable effort and expense has been invested in extraction and recovery of heavy crude oil. However, there has been limited commercialization of the developed technologies due to a combination of technical issues, limited throughput, expensive pre-treatment and post-treatment costs, poor operating efficiency, high energy consumption, or a combination of the above, resulting in limited production.

This present invention addresses many of the above commercialization impediments and provides a more efficient and cost-effective solution to substantially increase the extraction, recovery, and processing of heavy crude oil in the field.

SUMMARY OF THE INVENTION

The invention described herein pertains generally to a more efficient and cost-effective method and apparatus for: (1) coupling of microwave energy from a microwave generator or plurality of microwave generators into an integral set of applicators; (2) extraction and separation of organic compounds from a mixture of organic and inorganic compounds; and (3) recovery and conversion of the organic compounds to gaseous and liquid fuels.

The apparatus described in this invention result in improved microwave absorption within the mixture flowing through the applicators by increasing residence time within the applicators, resulting in a higher temperature within the material. The higher temperature lowers the viscosity of the solution, but also provides a limited reduction of the combination of complex chain and aromatic organic compounds to allow recovery of syngas and fuel oil.

This invention includes apparatus for extraction, recovery, and processing of heavy crude oil at the wellhead site and preparation for transport.

In accordance with the present invention, there is provided a method and apparatus which builds upon principles taught in issued U.S. Pat. No. 6,618,957 B2, which utilizes a microwave pyrolysis process developed for drying and limited breakdown of organic materials. This technology also builds upon aspects and principles developed and taught in issued U.S. Pat. No. 7,927,465 B2, a non-pyrolysis microwave reduction process for organic materials. The present invention builds on the foundation established in the previous patents and introduces a new method and apparatus, resulting in significant improvements in efficiency, cost, and reliability.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
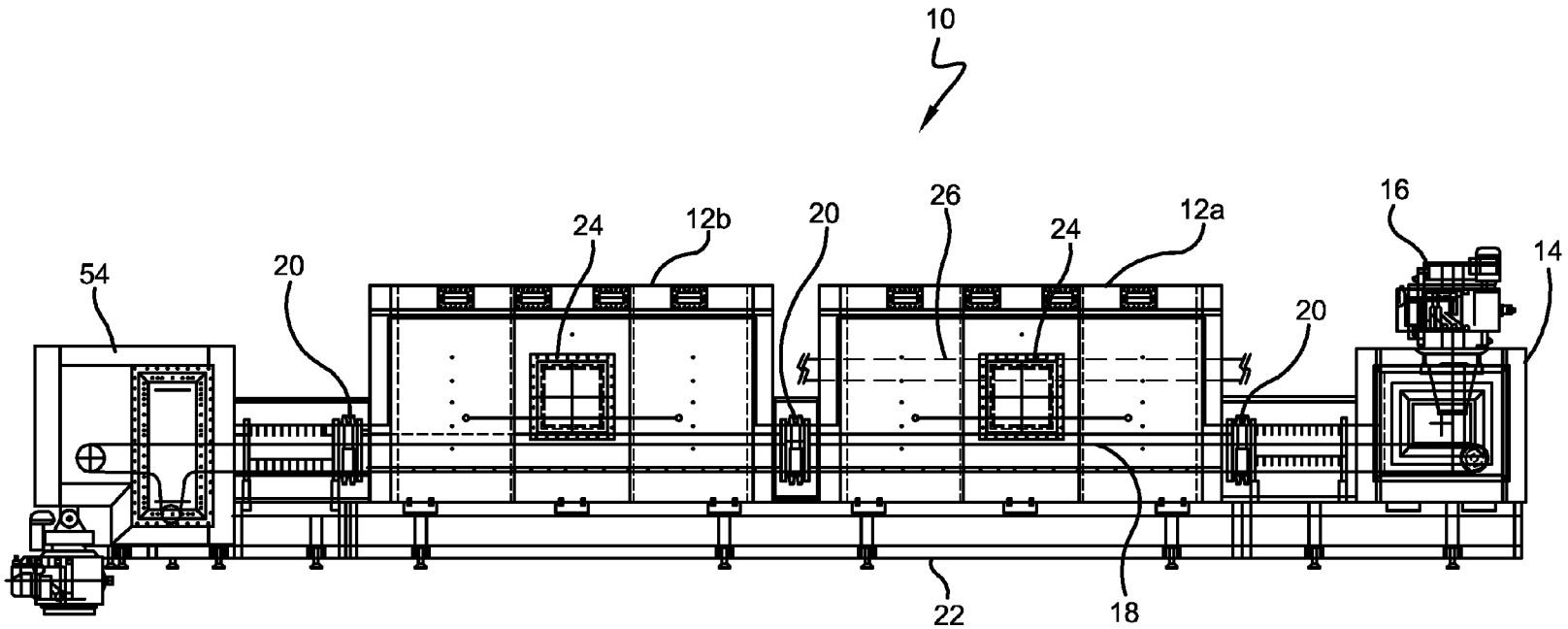
FIG. 1 is an elevation view of a two-module applicator assembly without waveguides illustrating at least one microwave-transparent tube entering and exiting one of the modules.

The best mode for carrying out the invention will now be described for the purposes of illustrating the best mode known to the applicant at the time of the filing of this patent application. The examples and figures are illustrative only and not meant to limit the invention, which is measured by the scope and spirit of the claims.

This invention pertains primarily to a non-pyrolytic microwave-based method and apparatus for: (1) coupling of microwave energy from multiple microwave generators into an integral set of applicators; (2) matching the applied microwave energy from the microwave generators to the volume of material within the applicator set; (3) even temperature distribution of high power density microwave energy within the flowing material; and (4) reduced overall energy consumption due to more efficient coupling of the applied microwave energy to an increased volume of material.

The apparatus presented in the following narrative includes integration of the traveling-wave applicator described in U.S. provisional patent application Ser. No. 61/267,255, now U.S. pending application Ser. No. 12/962,407, the application fully incorporated by reference, into the multi-mode applicator described in U.S. provisional patent application Ser. No. 61/311,432, now U.S. pending application Ser. No. 13/043, 074, the application fully incorporated by reference, to achieve a higher operating efficiency, along with increased temperature and throughput for high-volume processing of heavy crude oil in the field.

This apparatus and the associated process equipment are available as a set in either a trailer-mounted mobile or skid-mounted stationary configuration.

The inventions presented in U.S. patent application Ser. Nos. 12/962,407 and 13/043,074 teach efficient methods of using microwaves for processing of liquids and solids, respectively. Each of these microwave configurations teaches a specific method for processing organic materials. The microwave unit described in patent application Ser. No. 12/962,407 did not process solids while the microwave unit described in provisional patent application Ser. No. 13/043,074 did not process liquids. The invention presented here makes use of the methods and apparatus presented in the identified patent applications and provides a system capable of processing liquids, slurries, or solids through integration of both configurations in a single, dual-purpose, multi-mode applicator.

(I) Liquids Processing Using Microwaves

In the liquid processing application described in patent application Ser. No. 12/962,407, the invention generally pertained to a method and apparatus for improving fuel vaporization combustion efficiency, and soot reduction in combustion chamber(s); i.e., boilers, internal combustion engines, and gas turbines, through the coupling of high power density microwave energy into a tuned waveguide assembly, connected to a WR-975 waveguide containing a ceramic (e.g., alumina or zirconia) cylindrical applicator. Fuel vaporization was accomplished through establishment of a charge density in the cross-coupled applicator consistent with the applicator's volume, dielectric characteristics of the materials being processed, applied frequency, and applied voltage. This invention was also used for preheating or polarization of solids within a slurry conveyed through a pipe, such as biosolids, coal, paper pulp, or shale oil rock, to enhance the efficiency of a drying process through molecular misalignment of the constituent's dipoles. The invention had applicability as an integral part of a coal gasification process, employing both microwave and reduction methods to produce a high-Btu syngas with properties similar to natural gas, hydrogen with catalytic enhancement, and/or liquid fuels, including diesel, gas oil, and fuel oil. Finally, the invention had applicability for reduction of heavy crude oil, crude storage tank sludge or oil tanker bottoms through applied high density microwave energy and its subsequent heating effects due to molecular misalignment of the constituent's dipoles, enhanced conductivity due to the presence of salts, and high charge density at particle interfaces.

The system described is applicable to a single-fed microwave-based system designed for low flow, low pressure applications, such as in biodiesel applications, using one ceramic tube or when multiple ceramic tubes are used, in higher flow, higher pressure applications. This system is more application specific for particular liquids and light slurries, and may be tuned to a specific load.

An essentially microwave-transparent ceramic (zirconia, more preferably 99.8% alumina) tube is employed to contain the flowing liquid. An arc detector is installed to detect excess applied microwave power, resulting in an arc. The arc detection system built into the microwave generator will temporarily remove the magnetron anode power for 30 seconds, and attempt to transfer microwave energy into the waveguide.

Liquid is supplied through a liquid flow meter through a solenoid valve and check valve into the ceramic tube. The liquid to be processed flows through a ceramic tube inserted into the microwave applicator chamber and is exposed to high power density microwave energy. During this time, the process fluid is converted to a mixture of hydrocarbon gases. Upon exiting the ceramic tube through the solenoid valve, check valve, and condenser, the gaseous mixture enters a separation and recovery process as is known in the art. A condenser reduces the temperature of the process gas from its operating temperature to 75° F. (23.89° C.).

The heat rejected from the process by the condenser and the magnetron losses manifested as heat, are removed by the glycol/water mixture passing through a chiller package and its reservoir. The residence time within the chiller is sufficient to allow operation in a closed loop mode.

The gas/liquid separator separates the condensable liquids from the non-condensable gases. The gases exiting the separator, pressure control valve, fuel outlet isolation valve, and through a check valve to a surge drum located on the prime mover. The prime mover may be a reciprocating engine or gas turbine coupled to an electrical generator for cogeneration within the plant or to the electric utility grid.

A dual-fed microwave-based system is also designed for high flow, high pressure applications, such as heavy crude oil, crude oil, tank/tanker bottom sludge, and bituminous coal slurries, using a dual cross-coupled applicator and four ceramic (preferably 99.8% alumina) tubes to achieve maximum flexibility in processed materials.

In a preferred embodiment, the complete sludge processing plant is comprised of two skids, including the process generator skid, to accommodate transportation and achieve maximum portability. The lower skid includes microwave generators (preferably 100 kW) with 3-stage or 4-stage stub tuners and tuned waveguide assemblies, along with an air dryer and nitrogen generator. The upper skid contains a centrifuge, centrifuge feed pump, and two heaters. In addition, the upper skid includes an inlet buffer feed pump assembly, inlet buffer tank, gas particulate tank, process gas condenser, gas/liquid separator, liquid fuel storage tank and its pump, process gas compressor, feed gas air compressor for the air dryer and nitrogen generator. The upper skid also contains a pressurized cross-coupled applicator assembly.

Couplers, if necessary, can be used to seal and prevent leakage of both process gas and microwave energy, while providing compensation for thermal expansion within the coupler assembly. The coupler assembly includes a ceramic tube, aluminum tube, aluminum compression flanges, aluminum flanges, carbon fiber gaskets, aluminum spacers, and aluminum pipe.

The term pressurized cross-coupled applicator assembly is derived from the sense that two generators propagate microwave energy simultaneously toward their respective reflector plates. The pressurized fluid flowing through the ceramic tubes, which are constructed of extruded alumina 99.8% for their mechanical strength, dielectric, and thermal properties, along with their microwave transparency at the operating temperatures, absorbs all of the microwave power presented. As described in U.S. patent application Ser. No. 12/962,407 the pressurized fluid is exposed almost instantaneously to the high power density microwave energy four times during one periodic waveform generated by only two microwave sources. This method of exposure and to absorption of the microwave energy, results in a significant improvement in process heating efficiency, considering that the period of one waveform of microwave energy occurs in only 1.08 nanoseconds. This method of microwave application and absorption by continuously flowing pressurized liquids is one of the innovative aspects of the design and process.

It is through application of high power density microwave energy applied through the walls of the microwave-transparent ceramic tubes, and direct absorption of the microwave energy by the liquids flowing through the ceramic tubes, that reduction of the liquids occurs. Microwave reduction occurs at the molecular level, resulting in reduction of molecular size changes in molecular composition. Subsequently, reduction in viscosity occurs, allowing recovery of commodity fuels from the previously discarded sludge.

(A) Liquid Microwave System Components

Microwave Generators: Microwave generators operating at 915 MHz, with a continuously-variable power output of 0-100 kW in a constant efficiency mode, each couple their microwave energy output into a tuned WR-975 waveguide assembly.

Power Density Monitoring: Power density monitors are installed in each microwave generator to monitor the applied power to the applicator and the reflected power from the applicator by a pair of sampling diodes installed within a directional coupler mounted in the waveguide.

Waveguide Sections: The waveguide selected is WR-975, fabricated from ⅛" (0.3175 cm) wrought aluminum, Type 6061-T6. This material provides the necessary strength, durability, corrosion resistance, and electrical conductivity for this application. Each waveguide assembly includes a multi-stage stub tuner assembly to provide a constant load impedance to the generator.

Stub Tuners: A manually tuned, three-stage tuner assembly is used to match the output impedance of the microwave generator to the material flowing through the ceramic tubes in the applicator assembly. The stub tuner consists of a WR-975 waveguide section, one wavelength long, with three brass tuning screws. Each brass tuning screw is separated from the other by a distance of ⅛ wavelength. The tuning screws presents a change in capacitance and thereby, susceptance to the microwave waveform. The tuning assembly is inserted into the narrow wall of the WR-975 waveguide for tuning up to ¼ wavelength across the broad wall. The ¼ wavelength insures the effect is only capacitive, as adjustments beyond ¼ wavelength would produce an inductive effect. Adjustment of the tuning screws is made and observing the effect on a network analyzer. Adjusting tuning screws 1 and 2 moves reduces the microwave output power from the generator to the load. Adjusting tuning screws 2 and 3 increases the microwave output power from the generator to the load. Essentially, adjustment of the tuning screws provides a phase shift in the microwave output waveform to allow maximum absorption of the forward power, with minimum reflected power, thereby transferring maximum power from the microwave generator to the load at all times. Forward and reflected power may be measured across the sampling diodes in the directional coupler. A four-stage tuner assembly (described in conjunction with the solid microwave system components) may be used in place of the above-described three-stage tuner.

(B) Process Components

Centrifuge Feed Pump Assembly: The centrifuge feed pump assembly provides the pressure to pump the crude oil from an oil well or crude oil sludge from a storage tank or vessel to the centrifuge infeed heaters and subsequently to the centrifuge.

Centrifuge In-feed Heaters: Centrifuge in-feed heaters (18 kW) raise the operating temperature of the incoming sludge to 200° F. (93.33° C.) in order to enhance centrifugal separation of the solid and liquid phases of the materials contained within the slurry.

Centrifuge Assembly: This process uses a rotating disk centrifuge, which develops more than 1000 g's to break the cohesive emulsion interface between the solids and liquids suspended in a slurry. Solids, water, and crude oil are separated simultaneously from the slurry by centrifugal force and ejected independently into their respective holding tanks.

Inlet Buffer Pump Assembly: The inlet buffer pump assembly pumps the crude oil from the centrifuge crude oil holding tank into the inlet buffer tank for storage.

Inlet Buffer Tank: The inlet buffer tank provides intermediate storage of the crude oil for processing by the microwave-based liquid vaporization system.

Rupture Disk: The rupture disk is an overpressure safety device to avoid excess pressure to the microwave applicator. The rupture disk is set to fail at 10% above normal applicator operating pressure of 25 psig.

Safety Relief/Vent Valve: The safety relief/vent valve is set to open at 15% above normal applicator pressure of 25 psig. The vent valve also serves to open and close during the purge and pressurize cycles during startup of the process.

Applicator: The applicator is a dual-fed, cross-coupled device capable containing alumina tubes through which the heavy crude oil flows. The ceramic tubes contained within the waveguide through which the microwave energy is applied. The ceramic tubes are transparent to applied microwave energy, leading to direct absorption by the material as it flows through the tubes. Since the tubes are constructed of a low-loss material, no energy is wasted heating the tubes, then depending on heat transfer characteristics to heat the material, as in conventional processes. The direct absorption of high power density microwave energy reduces the asphaltenes and waxes, which produces a correspondingly lower viscosity, leading to relatively lighter liquid fuels such as fuel oil and diesel. The net result is a significant energy savings, contributing to higher process efficiency.

Gas Particulate Tank: The gas particulate tank contains a fine mesh screen to trap any particles suspended in the flowing gas stream, thus preventing the particles from forming deposits within the condenser on the tubes.

Condenser: The condenser is a cross-flow shell-and-tube heat exchanger which serves as a single-point distillation column to reduce the temperature of the hydrocarbon gas stream from 752° F. (400° C.) to 75° F. (23.89° C.) into two phases. This results in the formation of both gaseous (non-condensable) and liquid (condensable) components or byproducts.

Gas/Liquid Separator: The gas/liquid separator operates on centrifugal principles. The hydrocarbon stream from the condenser is directly into a vessel, whose entry point is off-center, leading to rotation of the inlet stream. Baffles within the separator direct the gaseous mixture to flow out the top, while centrifugal action forces the liquids against the walls, allowing a gravity-fed oil stream to drain toward the bottom of the separator.

Liquid Fuel Storage Tank: The liquid fuel storage tank accumulates the liquid output from the separator.

Process Gas Compressor: This process gas compressor creates a positive hydrocarbon gas flow from the gaseous output of the separator toward the process output for use in a prime mover, such as an engine-generator or gas turbine for electrical production in cogeneration mode within the plant or with a local utility. In the event of a process upset, the gas may be vented to atmosphere.

Flame Arrestor: The flame arrestor is at the end of the gas process line to prevent air from traveling in the reverse direction from atmosphere toward the process gas, resulting in combustion or explosion.

(C) Ancillary System Components

Air Compressor: The air compressor develops 150 psia from atmospheric air pressure and provides the pressurized air to as feed gas to the nitrogen generator.

Nitrogen Generator: The nitrogen generator is a pressure swing absorption (PSA) unit capable of high pressures and high flows. In contrast, the nitrogen generator used on the single-fed microwave-based vaporization system is a membrane type since only low flows and pressures are required.

Chiller: The chiller is used to remove the heat developed by the magnetrons, which is typically approximately 6-8% of full power or 2049-2732 Btu/hour. In addition, the chiller removes the heat rejected by the process condenser.

Water/Glycol Reservoir: The water/glycol reservoir is size with sufficient retention time to permit operation in closed-loop mode. In other words, the reservoir is only filled initially with a 50/50 mixture of water and ethylene glycol and operates continuously on that fluid. Other heat transfer fluids may be alternately be used such as commercially-available organic heat transfer fluids.

(D) System Control Components

PLC: The Programmable Logic Controller (PLC) is programmed for startup, operation, shutdown, and emergency shutdown sequences, as well as process monitoring, data logging, and report generation.

Gas Flow Meter: The gas flow meter is a pitot type sensor, converting gas velocity to flow and pressure. Temperature compensation is provided by a chromel-alumel (Type K) thermocouple for accurate indications of mass flow. The meter generates an output of 4-20 mA DC, whose control signal is proportional to the mass flow. This control signal serves as the bias for a variable frequency drive (VFD) operating the input buffer feed pump.

Variable Frequency Drive—Process Gas Compressor: The variable frequency drive (VFD) provides the voltage to the drive motor for the process gas compressor, which is proportional to the drive motor's speed. As the process gas compressor is a positive-displacement type, the flow is directly proportional to the compressor speed. As the flow increases, compressor must be able to remove the flowing hydrocarbon gases to maintain a constant system pressure, thus avoiding over pressurizing the microwave ceramic tubes.

Liquid Flow Meter: The liquid flow meter is a magnetic type sensor, converting changes in magnetic field to flow and pressure. Temperature compensation is provided by a chromel-alumel (Type K) thermocouple for accurate indications of mass flow. The meter generates an output of 4-20 mA DC, whose control signal is proportional to the mass flow. This control signal serves as the bias for a variable frequency drive (VFD) operating the input buffer feed pump.

Variable Frequency Drive—Inlet Buffer Feed Pump: This variable frequency drive (VFD) provides the voltage to the drive motor for the inlet buffer feed pump, which is proportional to the drive motor's speed. As the pump is a positive-displacement type, the flow is directly proportional to the pump speed. As the flow increases, the microwave system must be able to convert the flowing liquids to hydrocarbon gases at the rate of flow provided by the inlet buffer feed pump.

(E) System Control Methods

Sensors and their corresponding transmitters generate outputs of 4-20 mA DC proportional to process gas flow, liquid flow, level, pressure and temperature conditions. These transmitter signals are connected to the PLC for metering, sequencing and control. Coupled with control logic, sequences such as startup, operation, shutdown, and emergency shutdown are maintained in PLC software, backed up by non-volatile memory, such as EEPROM.

Further, the PLC communicates over an Ethernet bus, which permits remote interrogation of the process plant for effecting diagnostics, troubleshooting and repair. One can also remotely ascertain the current plant operating conditions. The PLC's Ethernet bus allows communication with the plant in real time.

Finally, security can be insured through on-site cameras monitoring particular sensitive areas, such as the process area, fuel storage area, and control room for any abnormal operating conditions.

At least one explanation for one design limitation of the invention in U.S. patent application Ser. No. 12/962,407 resides in the volume ratio of the applicator. The applicator is a section of WR975 waveguide with an internal rectangular cross-sectional area equal to 47.53125 $in^2$ (306.6526 $cm^2$). This is defined by standard EIA rectangular waveguide specifications to be 9.750 inches (24.765 cm) wide by 4.875 inches (12.383 cm) high+/−10%. The applicator produced from WR975 waveguide section is 48.000 inches (121.92 cm) in length, for a total volume of 2281.5 cubic inches (37387.09 $cm^3$). The volume of material within the zirconia tube or "ceramic pipe" with a diameter of 2 inches (5.08 cm) is 159.796 cubic inches (2618.587 $cm^3$).

The volume ratio is determined by the volume of material contained within the ceramic pipe passing through the applicator, to the volume of the section of waveguide. However, the material flow is limited by the internal pipe diameter, the pressure rating of the ceramic pipe, and the microwave coupling coefficient. The microwave coupling coefficient is defined as the ability of the material within the ceramic pipe to readily absorb microwave energy, in order to achieve the desired material temperature.

As the volume ratio increases, the microwave coupling coefficient decreases to a point where insufficient excitation modes exist to affect any heating of the material. The practical maximum volume ratio is approximately 15%. The volume ratio of the design of the apparatus described in U.S. patent application Ser. No. 12/962,407 is 6.6%.

(II) Solids Microwave Processing

In the solids processing aspect of the application as illustrated in U.S. patent application Ser. No. 13/043,074 the invention generally pertained to a method and apparatus for a microwave reduction process to more economically produce high quality syngas and liquid fuels, suitable for direct introduction into an Internal Combustion Gas Turbine (ICGT), in the petrochemical, industrial, and energy markets within a specified and controlled range of Btu content, while operating below current emissions levels set forth by the U.S. Environmental Protection Agency (EPA). Alternately, the output heat from the ICGT may be passed through a heat exchanger in a combined cycle application for the production of electricity, steam, or other waste heat applications. The gas turbine is coupled to an electrical generator to provide electricity for this invention. It is important to note that combustion of only the syngas fuel is sufficient to provide the total electrical requirements for the microwave system and ancillary support equipment, plus excess energy is available for export to the electrical grid. All of the recovered liquid fuel, carbon black, and steel are available as a revenue stream to the customer. For clarity, it should be noted that the heat potential of a scrap tire is approximately 15,500 Btu/lb (36,053 kJ/kg). The recovered syngas contains approximately 18,956 Btu/lb (LHV) (44,092 kJ/kg), the recovered fuel oil contains approximately 18,424 Btu/lb (LHV) (42,854 kJ/kg), and the recovered carbon black contains approximately 14,100 Btu/ lb (32,797 kJ/kg). The typical amounts of recovered by-products through microwave excitation of scrap tires, based on a typical scrap tire mass of 20 pounds (9.072 kg) is given in Table 1. It should be noted that operating conditions, such as applied microwave power, applicator pressure, temperature and residence time will determine the gas:oil ratio derived from the hydrocarbon gases identified in Table 1.

TABLE 1

Typical Scrap Tire Reduction By-Products from Microwave Excitation

| | | | |
|---|---|---|---|
| Hydrocarbon Gases: | 11.8992 lbs. | (5.397 kg) | 59.4958% |
| Sulfur as $H_2S$: | 0.0373 lbs. | (0.017 kg) | 0.1865% |
| Chlorine as HCl: | 0.0014 lbs. | (0.001 kg) | 0.0070% |
| Bromine as HBr: | 0.0125 lbs. | 0.006 kg) | 0.0627% |
| Unspecified: Carbon Black: | 4.8712 lbs. | (2.209 kg) | 24.3560% |
| Metal Oxides/Fillers: | 0.8683 lbs. | (0.394 kg) | 4.3415% |
| Plated High-Carbon Steel: | 2.3101 lbs. | (1.048 kg) | 11.5505% |
| Total: | 20.0000 lbs. | (9.072 kg) | 100.0000% |

When the heat content of the various recovered by-products is considered in conjunction with the mass percentages given in Table 1, an energy balance exists between the heat contained within the scrap tire feedstock and the heat recovered from the microwave-reduced scrap tire by-products. A mass balance is also achieved between the tire feedstock and various recovered by-products.

High power density microwave energy has been utilized effectively to reduce polymers through molecular excitation of polar and non-polar molecules, while producing intermolecular heating within low-loss dielectric materials.

Solid feedstock is typically scrap tire material received from a scrap tire processing plant. The material is typically shredded in randomly sized pieces from ½ inch (12.7 mm)× ½ inch (12.7 mm) to about 1 inch (25×4 mm)×1 inch (25.4 mm), usually containing all of the steel associated with the scrap tires. Some scrap tire shredders will remove about 60% of the steel, as part of the scrap tire processing for crumb rubber applications. This invention can process shredded scrap tire material with or without the steel. Laboratory data indicates that the overall microwave process efficiency increases approximately 10-12% with the reduced steel content in the scrap tire material, due to reduced reflected power, which is more than enough to offset the cost of steel removal during the scrap tire shredding operation.

The apparatus as originally designed and embodied in U.S. patent application Ser. No. 13/043,074 included six (6) major elements (1) a sealed microwave reduction multi-mode applicator, coupled to a mobile set of microwave generators, (2) a nitrogen generator, which displaces any air within the microwave applicator and provides a non-flammable blanketing gas over the organic material under reduction, in this case, scrap tire material, (3) gas process condenser, which receives the hydrocarbon vapor stream from the output of microwave applicator, (4) a gas-contact, liquid scrubber, which removed hydrogen sulfide, hydrogen chloride, and hydrogen bromide contaminants, (5) an air-water chiller, which provides continuous cooling water to the magnetrons and control cabinets for heat rejection, and (6) an electrical generator, sized to provide all electrical energy to the microwave system and ancillary equipment.

Within the microwave generators, were microwave generators in continuous electronic communication and controlled by a PLC in a main control panel. Each microwave generator has a magnetron and a microwave circulator with water load. The generated microwaves are coupled from each microwave generator to microwave reduction applicator via rectangular waveguides. An exhaust fan with associated motor to extract the hydrocarbon vapor from the applicator and convey the vapor stream to process gas condenser is also employed.

In its original design, each waveguide assembly contained a bifurcated waveguide assembly, which directed the microwave energy into specific microwave entry ports in a direction collinear with the longitudinal plane of the applicator conveyor belt and normal to this same longitudinal plane. Microwave leakage outside of the sealed applicator was eliminated by an RF trap, consisting of an array of choke pins, designed to a length appropriate for the operating frequency. This original design, while still functional, is improved in the embodiment of the design illustrated in FIGS. 2-3, discussed herein.

The microwave reduction applicator had one entry port and one exit port, which were in longitudinal communication with a closed-mesh, continuous, stainless steel belt, said belt being of mesh composition, set within a pair of side guides, and having longitudinal raised sides for retention of the sample, said sides being approximately 4 inches (10.16 cm) in elevation. Multiple microwave reduction applicators may be interconnected to form a continuous chamber. Early versions of the microwave reduction applicator consisted of two (2) or four (4) waveguide entry ports, depending on the specific application and the microwave power required for the application.

Microwave energy was coupled from the microwave generator to the applicator via rectangular waveguide assemblies and exited the same through a bifurcated waveguide assembly. The source of the microwave energy is a magnetron, which operates at frequencies, which range from 894 MHz to 2450 MHz, more preferably from 894 MHz to 1000 MHz, and most preferably at 915 MHz+/−10 MHz. The lower frequencies are preferred over the more common frequency of 2,450 MHz typically used in conventional microwave ovens due to increased individual magnetron power and penetration depth into the organic material, along with an increase in operating efficiency from 60% in the case of 2450 MHz magnetrons, to 92% for 915 MHz magnetrons. Each magnetron has a separate microwave generator control panel in electronic communication with a main control panel for system control.

The microwave reduction applicator had an active area, whose boundaries are set by interior roof sheets and stainless steel belt. The active microwave reduction chamber height was 24 inches (60.96 cm). It is well known how to appropriately size the active area of a microwave chamber. A belt traversed through the active area between two (2) continuous guides, whose open dimension is sufficient for the belt to pass, but is not a multiple or sub-multiple of the microwave frequency. The height of the guides was a nominal 4" (10.16 cm), which contained the material on the belt. The closed-grid belt provided the lower reference, which became the bottom of the active area of the applicator.

In the event that the microwave energy was not absorbed by the organic material, a condition, which results in reflected microwave energy, this energy was redirected by a device known as a circulator and subsequently absorbed by a water load. The circulator was sized to absorb 100% of the microwave energy generated by the magnetron. Each magnetron transmitted its energy via waveguides through a quartz pressure window assembly, into the series-connected microwave reduction chamber(s). Quartz pressure window assemblies included two flanges separated with rectangular waveguide, one (1) wavelength long, each flange containing a milled recess to accept a ¼" thick fused quartz window, which is microwave-transparent. This quartz pressure window assembly was installed between a waveguide and either a microwave entry port or into the applicator chamber to contain the pressure within the microwave reduction chamber and prevent any potentially hazardous gas from entering the waveguide system back to the microwave generator. Quartz pressure windows assemblies are pressurized with nitrogen from a nitrogen generator, and referenced to the internal microwave reduction chamber pressure. This insured that excess pressure could not build up on the reduction chamber side of the quartz window assembly, resulting in a failure of the quartz window, and, with the introduction of air into the reduction chamber, create a fire or explosion hazard. In a preferred embodiment, each microwave generator operated at a center frequency of 915 MHz+/−10 MHz.

In the original configuration, the waveguide entry into this applicator was via a three-ported bifurcated waveguide assembly, which equally divided the electromagnetic wave of microwave energy prior to the two-plane entry into the top of the applicator chamber, while maintaining electric field dominance. The waveguide inputs to the applicator chamber from the bifurcated waveguide assembly were in the same plane on the top of the applicator, but one waveguide plane was oriented along the x-axis, while the other waveguide plane was oriented along the y-axis. The split waveguide assemblies were designed so as to produce microwaves, which are essentially 90° out of phase. This resulted in the generation of multiple modes of microwave energy within the applicator chamber and elimination of the requirement for mode stirrers, while providing a more uniform distribution of the microwave energy throughout the applicator.

The microwave energy was produced by the microwave generator and transmitted into a WR-975 standard rectangular waveguide, fabricated from high-conductivity, low-loss 1100S aluminum, instead of the more conventional 6061 aluminum. The choice of low-loss aluminum resulted in less losses throughout the waveguide system from the microwave generator output to the microwave reduction chamber inputs. It was recognized however, that low-loss aluminum 3003-H14 and similar compositions are applicable to this invention in its current form.

Generally, when mobile units are desired, with the microwave generators mounted on one trailer and the applicator mounted an adjacent trailer, it is customary to accomplish coupling of the microwave energy between the two trailers via a ribbed, flexible waveguide assembly. However, there is also a tendency for those performing field alignment of the two trailers to bend the flexible waveguide beyond its specified limits of +/−0.010 inches (0.254 mm), resulting eventually in a crack or fatigue failure of the flexible waveguide assembly. Failure of any joint in the waveguide assembly will cause microwave leakage into the surrounding area, resulting in a hazard to personnel and potentially interfering with communications equipment. It is understood that flexible waveguides may be used for this application, but are not shown in the drawings. The microwave unit could also be positioned on a floating base frame assembly.

In the original configuration, the microwave energy exited the microwave generator trailer and entered a bifurcated waveguide assembly. One output connected to a right angle waveguide section, from which the microwave energy entered directly into the microwave chamber. The other output is presented to a two-section, long-radius, right angle waveguide section, which accomplishes the turning of the microwave energy path 180°, while maintaining electric field dominance. The microwave energy entered a short straight section and another long-radius, right angle waveguide section. The microwave energy was then coupled into a right angle waveguide section and entered through a quartz pressure window assembly directly into the microwave reduction chamber.

In the original arrangement, although the waveguide entries into the applicator reduction chamber were in the same plane on the top of applicator, the orientation of the two waveguide entries relative to the centerline of the applicator, were 90° to each other. One waveguide entry section to each applicator entry point was parallel to the flow of the organic materials, while the other was perpendicular to the flow of the organic material. The distance from the output from the bifurcated waveguide, which couples the microwave energy to the applicator entry point parallel to the flow of the organic material, was physically much longer than the output feeding the perpendicular port. This additional length resulted in a different characteristic impedance at the microwave chamber entry point, a time delay in the microwave energy reaching the applicator entry point, and a relative phase shift in the energy wave itself. As stated previously, the microwave generator operated at a center frequency of 915 MHz+/−10 MHz. At this frequency, the effects of additional waveguide lengths and bends present a very noticeable change in the time/phase relationships due to the impedance mismatch. The impedance mismatch results in a phase shift of 90 electrical degrees. The significance of the 90° phase shift manifests itself in the type of polarization present in the microwave reduction chamber. Each microwave input from the bifurcated waveguide assembly is a linear polarized wave. When two linear polarized waves, separated in time quadrature by 90°, circular polarization occurs. In this invention, the impedance mismatch, phase shift in microwave inputs to the applicator, and resulting circular polarization, along with the chosen frequency of operation, is a significant contribution to the microwave energy mixing within each microwave reduction chamber, allowing more even microwave energy distribution throughout the entire applicator.

Microwave reduction occurred preferentially in a continuous mode, as opposed to a batch mode, and organic material was continuously, but synchronously, entering and exiting the microwave applicator. During the entry and exit times, it could be possible that microwave energy could propagate into the surrounding area, resulting in a possible hazard to personnel and create radio frequency (RF) interference. To prevent leakage of microwave energy from the active area of the microwave applicator, RF traps containing a matrix or array of grounded ¼-wavelength RF stubs (antennae), with ¼-wavelength spacing between the RF stubs in both the x-plane and y-plane, were installed at each end of the applicator to insure attenuation of microwave energy for compliance with leakage specifications of <10 mW/cm$^2$ maximum for industrial applications and <5 mW/cm$^2$ maximum for food applications.

As described with particular reference to an original configuration, the active area in the microwave chamber consisted of a rectangular cavity, measuring 8 feet long (2.44 meters)×4 feet (1.22 meters) wide×2 feet (0.61 meters) high, designed specifically for the microwave energy coupled from one (1) or two (2) microwave generators. This is referred to as a microwave reduction chamber or one applicator module. Multiple microwave reduction chamber modules may be connected together to form an applicator. In one configuration, three (3) microwave reduction chambers were employed, which receive microwave energy from five (5) microwave generators and five bifurcated waveguide assemblies, which result in ten (10) sources of microwave energy to the applicator and even more uniform microwave energy distribution.

The applicator also contains a continuous, self-aligning, closed mesh, 4 feet (1.22 meters) wide, Type 304 stainless steel belt, which transports the organic material into the applicator at an entry port, through the active area of the applicator and exits out of exit port.

Just as the applicator and microwave are chosen to accommodate a specific throughput of scrap tire material equivalent to 100-8,000 tires per day, infeed and outfeed assemblies, along with microwave reduction chamber are also sized volumetrically to process the specified amount of material. As this invention is capable of operating preferentially in continuous mode, as opposed to batch mode, the feed systems operate independently, yet synchronously with the movement of the material on belt though the applicator reduction chamber.

Initially, the applicator reduction chamber is purged with five (5) volumes of nitrogen gas to displace any air within, and is maintained in a slightly pressurized state, approximately 0.1 psig (0.689 kPa) above local atmospheric pressure. This insures that no air migrates into the applicator reduction chamber during opening of either infeed or outfeed shutter systems. Since the applicator is slightly pressurized, nitrogen will flow toward the sealed shutter assemblies, instead of air flowing into the microwave reduction chamber. At startup, all slides on the infeed shutter system and outfeed shutter system are closed.

The internal walls of the applicator are made from either low-loss 1100S aluminum plate or Type 304 stainless steel, depending upon the application. High temperature applications in excess of 900° F. (482° C.) and corrosive atmospheres require the use of Type 304 stainless steel. Microwave reduction of scrap tires results in an equilibrium temperature occurring at 680° F. (360° C.) in a relatively non-corrosive atmosphere, therefore, 1100S aluminum plate is the material of choice. In microwave reduction applications such as plastics, particularly polyvinyl chlorides (PVC), hydrochloric acid is produced in voluminous amounts, contributing to surface corrosion, as well as stress corrosion cracking; therefore, Type 304 stainless steel is preferred The type of gaskets used around microwave viewing/access doors for gas containment requires a round silicone gasket for non-corrosive atmospheres or a Teflon-enclosed epoxy gasket for corrosive atmospheres. In either application, a carbon-filled Type 304 stainless steel mesh gasket is used for microwave containment around the viewing/access doors. The hydrocarbon gases exit through a transition plenum duct from a rectangular cross-section at the applicator to a circular cross-section to accommodate a ten (10) inch (25.4 cm) pipe containing a tee, whose branch is connected to a rupture disk rated at 15 psig (103.4 kPa), and a rotary-disk butterfly valve. The applicator discharge valve serves to control the applicator static pressure, which is the result of the hydrocarbon gases generated during microwave reduction of the organic materials plus nitrogen purge gas.

The microwave generators are preferably each rated at 100 kW, with circulators with water loads, each rated at 100% power generated by their respective magnetrons, and switched-mode power supplies (SMPS), which contain all power and control signals, along with metering for the magnetrons and control electromagnets, plus digital and analog interfaces to the Programmable Logic Controller (PLC). The SMPS operates at a typical efficiency of 91%, and eliminates the less efficient, heat-producing power transformer, along with the six-phase bridge rectifier assembly, SCR controllers, filtering, and associated wiring. The additional benefit of the SMPS is that, in the event of an immediate shutdown, the output voltage of the SMPS almost immediately (<10 mS) decreases to zero (0) volts. However, in the case of the transformer power supply, the internal capacitance between the transformer windings, can store a lethal voltage for several hours. The other undesirable effect from the transformer power supply is that after a shutdown, the stored charge within the transformer can cause the magnetron to operate outside its rated operating envelope and cause premature magnetron failure.

The PLC provides metering, sequencing and control of the microwave generator, conveyor motors and applicator controls. The only additional requirement is cooling water in the amount of 5 gallons per minute (18.93 liters/minute) per 100 kW magnetron and 3 gallons per minute (11.35 liters per minute) per circulator water load. Each microwave generator is a two-door enclosure with front and rear door access, measuring 48 inches (1.22 meters) long×84 inches (2.13 meters) high×24 inches (0.61 meters) deep, which is a footprint reduction from conventional microwave generator systems.

To process additional material or increase the throughput, one may add additional microwave generators, microwave applicator modules, increase belt speed, or increase the organic material bed depth proportionally. For small variations in the power requirement due to slight inconsistencies in the material being processed, the belt speed may be adjusted to change the dwell or residence time of the organic material within the applicator. Belt speed control is accomplished by changing the conveyor speed setpoint on the touchscreen, mounted on the front of the Main Control Panel, adjacent to the line of microwave generator panels.

It has been determined that the process characteristics relative to throughput and power consumption are linear from minimum to maximum throughput.

The standard design, which supports the majority of organic material reduction processes with high power density microwaves, contains three (3) microwave modules per applicator. Through careful design, this modular concept may be extended to include a maximum of 80 microwave generators or 16 modules within one applicator, in a stationary design.

In one aspect of the invention, the design of the unit is a mobile demonstration unit, with the microwave generators and control cabinets, along with the Main Control Panel, scrubber, nitrogen generator and chiller mounted in one trailer and the microwave applicator assembly and electrical generator mounted on an adjacent trailer.

Microwave system control is accomplished by the use of a Programmable Logic Controller (PLC) with Digital and Analog Input/Output (I/O) Modules and a Data Highway to a Remote Terminal Unit (RTU), which are all mounted in the Main Control Panel (MCP). The RTU is also known as an Operator Interface Terminal (OIT), as the touchscreen on the OIT is the operating interface to the microwave reduction system. PLC communications modules are mounted in each microwave generator enclosure, which permits continuous bidirectional communication between the PLC and the OIT or touchscreen. The PLC program provides continuous sequencing, monitoring and control functions in real time. The PLC program also communicates along a data highway to display alarm/shutdown status and operating parameters on the touchscreen The touchscreen provides multiple displays in both digital and analog formats in real time. The summary status touchscreen indicates power output, reflected power, anode current, anode voltage, filament current, electromagnet current, generator cabinet temperatures, applicator temperatures and pressures, internal and external water temperatures, hydrocarbon vapor flow rates, process operating curves, PID control loop status, and parametric data from the nitrogen generator, chiller, process condenser, and scrubber, all in real time.

Additional magnetron protection is insured by a directional coupler system, which monitors forward and reflected power, and de-energizes the high voltage to the magnetron in the event of sensing more than 10% reflected power. An arc detection system further protects the magnetron, three-port circulator, and waveguide by de-energizing the high voltage upon detection of arcing within the applicator. Fire detection within the applicator includes infra-red (IR) sensors, smoke detection and rate-of-rise temperature detectors plus combustible gas detectors adjacent to the applicator, which are all wired in series with the safety shutdown system. A multiple-bottle nitrogen backup system serves as a deluge system in the event of a fire, plus provides nitrogen backup, in the event of a nitrogen generator failure.

Any shutdown parameter, which exceeds its preset limit, initiates an immediate shutdown of the high voltage system, and enables the safety shutdown system to proceed through an orderly and controlled shutdown. The safety shutdown system includes both fail-safe hardwired circuitry and PLC shutdown logic, along with local and remote emergency stop buttons to insure maximum protection for operating and maintenance personnel and equipment. Microwave access/viewing doors, microwave generator doors, and power supply enclosure doors are provided with fail-safe, safety switches, which are interlocked with the PLC program, and monitored during microwave operation to protect operating and maintenance personnel from exposure to microwave energy and shock hazards.

Further, the applicator access/viewing doors contain slotted ¼-wavelength chokes and dual fail-safe safety switches, interlocked with the PLC program to immediately (10 mS) switch off the high voltage, in the event of opening during operation. Switching off the high voltage immediately suspends magnetron operation, and hence eliminates any output of microwave energy. Other safety equipment integrated into this invention include a dual-keyed, fused manual disconnect for the main power source from the electrical generator or the customer's utility and a high speed molded case breaker, with electrical trip and shunt voltage trip tied to the shutdown system. Finally, a copper ground bus bar dimensioned 24 inches (0.61 meters) long×2 inches (5.08 cm) high×¼ inch (6.35 mm) thick is provided to insure absolute ground integrity from the main power source to all equipment included with this invention.

PLC programming utilizes standard ladder logic programming, reflecting hardwired logic for digital inputs and outputs, whose logic functions are programmed with Boolean expressions. Special function blocks, including preset setpoints, are used for analog inputs and outputs. The emergency shutdown switches are normally closed (push to open), the low level switches must reach their setpoint before operations may be sequenced, and the high level switches will open upon exceeding their setpoint. Any open switch in the series shutdown string will cause the master shutdown relay to de-energize, which results in de-energizing the high voltage circuits and forces the PLC to execute an immediate, sequential, controlled shutdown.

When gasifying shredded scrap tires, the preferred gaseous product is a hydrocarbon vapor stream, which consists of substantially ethane and methane in a ratio of two parts ethane to one part methane by weight plus 10% by weight nitrogen. A product stream, which varies from the preferred range, but is still acceptable, includes ethane, methane, and propane, at two parts ethane, to one part each of methane and propane, in addition to 10% by weight nitrogen. Another product stream, which varies further from the preferred range, but is also acceptable, includes ethane, butane, methane, and propane, at two parts each of ethane and butane to one part methane, and one part propane by weight, in addition to 10% by weight of nitrogen. Mixtures of ethane/methane, as well as those also containing propane and butane, have very high heat values, even when diluted with 10% nitrogen by weight, but can be directly injected into some ICGT combustion chambers without further treatment.

Conditions within the microwave applicator are selected so as to produce the desired components or gas:oil ratio in the hydrocarbon vapor stream. In a preferred embodiment, no liquid products, e.g., oils, will be produced. In order to insure that a 2:1 ratio of ethane:methane is produced, the feed rate, residence time, power density, energy level from the magnetrons is controlled as well as the pressure and temperature within the applicator.

In a typical scrap rubber tire reduction case, the following conditions will produce the desired ethane:methane mixture. The preferred applicator will contain anywhere from 3 to 10 microwave chambers, preferably six (6) magnetrons, each magnetron operating at about 915 MHz. Under these conditions, at steady-state operation, a residence time of approximately 285 milliseconds in the applicator, will result in a temperature in the applicator of about 680° F. (360° C.). Typically, the process pressure within the applicator will range from 0.1 to 0.5 psig (0.69–3.45 kPa). As kinetics favor reactions below equilibrium, the intermediate reactions release free hydrogen, which furthers the reduction of more complex organic molecules, leading to further breakdown, and a higher rate of reduction. The chemical reactions are exothermic in nature.

For crosslinked styrene-butadiene rubbers (SBR), the production of gaseous products includes the initial depolymerization of the sulfur crosslinks, followed by the addition of further microwave energy over time, resulting in the depropagation and breakdown of the two main polymers to form the desired products. At temperatures above about 680° F. (360° C.), depending on the feedstock, thermodynamics favor methane and ethane over the original polymers or other polymers. Accordingly, once depropagation and depolymerization is complete by maintaining those temperatures and applying the requisite microwave energy over a period of time, the gas stream remains stable at the high temperature. Very rapid cooling will prevent repolymerization or recombination of the gas constituents. The hydrocarbon gas stream is then flash-cooled, preferably down to about 100° F. (38° C.), to stabilize the ethane and methane at the lower temperatures. The residence time of the gas stream in the applicator is controlled in large part by the total pressure imposed by the nitrogen purge gas and the pressure developed by the formation of the hydrocarbon gaseous products of reduction, in conjunction with the flow rate set by the eductor at the inlet of the gas scrubber. The hydrocarbon vapor stream is then scrubbed to remove hydrogen sulfide, hydrogen chloride, and hydrogen bromide gases, hereafter referred to as contaminants.

The hydrocarbon vapor stream is scrubbed of its contaminants by a dry-contact, top-fed packed tower, packed with limestone and dolomite, while maintaining the gas temperature above the equilibrium point. A compressor must be used to force the hydrocarbon vapor stream through the scrubbing tower. The clean hydrocarbon vapor stream then exits and is flash cooled in an aluminum air-to-air heat exchanger, with liquid nitrogen acting as the cooling medium. The dry scrubber removes approximately 95-97% of the contaminants.

Alternately, the hydrocarbon vapor stream is scrubbed of its contaminants, preferably by a gas-contact, liquid scrubber, containing a dilute, aqueous solution of sodium hydroxide (NaOH) and sodium hypochlorite (NaOCI). The liquid scrubber eliminates the requirement for a compressor, as the scrubber eductor effects a 6 inch (15.24 cm) vacuum on the hydrocarbon gas stream flowing at approximately 285 acfm (484.2 $m^3$/hr). The scrubber is designed with two 12 inch (30.48 cm) diameter towers, containing special packing to minimize the overall height. The entire scrubber system is manufactured from high-density polyethylene. The liquid scrubber removes 99.99% of the contaminants, requires less space, and is more cost-effective in regards to the consumable chemicals than the dry scrubber. The scrubber tank containing chemical solutions is mounted under the twin packed-towers to provide stability to the towers in the mobile version. Column height, diameter and chemical tank size is determined by the process gas equilibrium and the desired removal efficiency.

Control of the liquid scrubber with its blowdown, makeup, and scrubbing cycles, is accomplished by the same PLC program, used for control of the microwave reduction process. In the mobile version of the invention, the liquid scrubber is installed in the microwave generator trailer, forward of the microwave generators and power distribution center. In the mobile version of the invention, makeup water for this system is pumped from a water reservoir installed under the applicator on the applicator trailer. Regardless of which scrubber is used, the hydrocarbon vapor stream exits the applicator and passes through a multiple-pass, water-cooled water-to-air process gas condenser. The process gas condensor provides cooling and stabilization of the gaseous products, while allowing recovery of the oil products. Residence time in the condensor is sufficient to allow the oil forming reactions to go to completion, while permitting the lighter, paraffin gases to stabilize and be drawn to the liquid scrubber.

A blanketing or purge gas is often used, nitrogen and argon being the two preferred gases. This gas may be supplied through drilled orifices through the choke pins in each R.F. trap. Nitrogen is preferred due to its lower cost, but has the potential of reacting with aromatic gaseous products of reduction, such as benzene, toluene, xylene, etc. With precise control of the applied microwave power and hydrocarbon gas residence time, in order to achieve the necessary reduction, formation of nitro-arene compounds can be avoided. Nitrogen gas is provided by a nitrogen generator, which includes a compressor and molecular sieve to produce relatively high-purity 98% purity) nitrogen.

The nitrogen generator is backed up with eight standard nitrogen bottles, in the event of a failure, while also acting as a deluge system in the event of a fire in the applicator. In the mobile version of the invention, the complete nitrogen system is installed in the microwave generator trailer forward of the hydrocarbon vapor scrubber. Oxygen sensors are also installed in this trailer to warn of a nitrogen leak, to prevent asphyxiation due to displacement of the air by the nitrogen.

Alternately, argon can be used since it is an inert gas, but at a higher cost, although lowered accounts are typically required due to its higher molecular weight. When operating this invention in the plasma mode, argon is used as both the plasma gas and the blanketing gas, thereby eliminating the possible formation of unwanted nitrogen-arene products.

Although the 100 kW magnetrons operate at 92% efficiency, the remaining 8% manifests itself as heat. Rejection of this heat is accomplished by a water-air chiller, sized for up to six (6) microwave generators. With the replacement of the inductive (transformer-based) power supply system with the switched-mode power supply, total heat load is reduced. In the mobile version of the invention, the chiller is installed at the front of the microwave generator trailer, forward of the nitrogen generator system. In the mobile version of the invention, cooling water is pumped from a water reservoir, installed under the applicator on the applicator trailer, through the chiller system and back into the microwave generators in a closed-loop mode.

Power for the mobile version of the microwave reduction system, is provided by an onboard diesel electric generator, capable of generating 750 kW, which is the total load from the microwave generators totaling 600 kW of microwave energy, and the ancillary items, including the nitrogen generator system, liquid scrubber system, and chiller system. All pertinent electrical parameters regarding the diesel generator operation are displayed on a continuously updated LCD module, located on the front of the generator control panel. Fuel for the diesel electric generator is pumped from a day tank, installed under the forward section of the applicator on the applicator trailer.

As stated previously, this process is, by definition, non-pyrolytic; requiring no externally-applied heat and achieving the dissociation of scrap tires and other organic compounds through molecular excitation of the organic molecules solely through the application of high power density microwave energy. Further, again by definition, power density (Watts/cubic feet) equals the applied microwave power (Watts) simultaneously to the entire volume (cubic feet) of material within the applicator. Other factors influencing power density and subsequently the applicator design are the applied frequency, permittivity, microwave absorption characteristics, and the voltage breakdown of the material within the applicator.

Conversely, pyrolytic reduction, by definition is the use of externally-applied heat to achieve thermal decomposition of organic compounds in a reduced oxygen atmosphere and involves the following steps: (1) subjecting the material for reduction to high temperatures from an externally-applied heat source, consuming considerable amounts of energy; (2) processing the products of reduction, such as melted rubber, oil, and char, which required special handling for safety and transportation; and (3) combustion of reduction products at high temperatures in the range of 932-1,472° F. (500-800° C.), resulting in additional environmental issues, such as formation of dioxins and other carcinogens.

By comparison, the microwave dissociation or reduction process for organic compounds achieved by this present invention requires: (1) no externally-applied heat source and is energy efficient—pyrolysis processes are typically 35-40% efficient, while the microwave presented in this invention achieved an operating efficiency of 93.5%; (2) no further processing, special handling or safety and handling considerations; and (3) dissociation or molecular breakdown of organic compounds occurs without combustion attributable at least in part to the high power density microwave energy, thus avoiding any environmental issues—using only microwave energy, the operating temperature to achieve necessary dissociation occurs at the reduced temperature range of 680-716° F. (360-380° C.) due to the severe intermolecular stresses created by absorption of the applied microwave energy.

The invention uses primarily passive components to overcome the mechanical and electromechanical limitations of methods used previously, in particular utilizing phase shifting of the microwave energy wave, to accomplish an impedance mismatch and subsequent phase rotation of the microwave energy waveform at an applied microwave frequency of 915 MHz prior to its introduction to the applicator, which is developed further in this invention, and which is still initially accomplished by incorporating unequal lengths of waveguide between the microwave generators and the applicator.

More specifically, in one embodiment of the invention, the microwave applicator will have the following specifications as illustrated in Table 2.

TABLE 2

| Microwave Applicator Specifications |
|---|
| Channel Length: 7¾ inches (19.7 cm) long |
| Channel Width: ½ inch (1.27 cm) |
| Channel Cross-Sectional Area: 99.84 square inches (644.13 $cm^2$) |
| WR-975 Cross-Sectional Area: 95.06 square inches (613.29 $cm^2$) |
| Channel Entrance Angle: The channel entrance has a milled radius of 15/64 inch (0.60 cm). Alternately, an entrance angle of 45° may be milled on the diffusor plate. |
| Channel Exit Angle: The channel exit has a milled radius of 15/64 inch (0.60 cm). Alternately, an exit angle of 45° may be milled on the diffusor plate. |
| Channel Separation: ¾ waveguide wavelength |
| Number of Diffusor Channels per Generator Inputs to Applicator: 12 downstream of each output from the divaricated waveguide assembly. |
| Applicator Dimensions: 144 inches (365.8 cm) long × 72 inches (182.9 cm) wide × 60 (152.4 cm) inches high |
| Applicator Active Area: 144 inches (365.8 cm) long × 52 inches (132.1 cm) wide × 42 inches (106.7 cm) high |
| Applicator Volume: 314,496 cubic inches (5.15 $m^3$) |
| Material Depth: 2.75 inches (6.99 cm) |
| Material Volume: 20,592 cubic inches (0.34 $m^3$) |
| Volume Filling Factor: 6.55 |
| Power Density: 592.24 $kW/m^3$ |

Without being held to one theory of operation, or one mode of performance, it is believed that the benefits of the invention are derived at least in part, by introducing microwave excitation of water molecules inside the organic material by subjecting the material to high frequency radio waves in the ultra-high frequency (UHF) band. The polar water molecules in the material attempt to align themselves with oscillating electric field at a frequency of 915 MHz or approximately every nanosecond. As the molecules cannot change their alignment synchronously with the changing electric field, the resistance to change manifests itself as heat, and the moisture trapped within the material is released as water vapor or steam. The heat conducted through the material and capillary action within the material converts any surface moisture to water vapor. This efficient release of moisture from the organic material reduces energy costs and increases throughput. In the case of non-polar molecules, the applied microwave energy is coupled to the entire volume of the material, resulting in dielectric polarization. Since a phase difference occurs between the applied electric field and the energy absorbed within the material, the losses within the material act as a resistance, resulting in additional heat generated within the material. The heat generated from dipolar and dielectric heating of the material is sufficient to effectively cause bond dissociation, generation of free radicals and hydrogen, resulting in the volumetric reduction of the material and formation of recoverable by products.

As the invention is designed for unattended, automatic operation, with a display in the customer's main control room, no additional operating personnel are needed. The use of this invention results in an immediate increase in process efficiency from 20-30% with incineration, 30-40% with pyrolysis, to over 85% with high-density microwave energy operating at 915 MHz, and to over 93.5% by employing the improvements described with the current invention, without any consideration for heat recovery.

However, in the case of tires, plastics, PCB's, e-waste (computer waste), roofing shingles, shale oil and bituminous coal, a phenomena known as thermal runaway, occurs due to the inability of these materials to dissipate the internal heat, caused by microwave excitation of polar and non-polar materials, sufficiently fast to their surroundings. Therefore, the increase in enthalpy is greater within the material than in the surrounding region. The internal temperature continues to increase at an even faster rate, and decomposition of the organic material subsequently occurs. When a high power density electric field is applied at 915 MHz, metal particles within the material separate, leading to a higher loss factor, particularly after decomposition begins, resulting in products of decomposition with an even higher loss factor. Since the loss factor is directly proportional to the power density and the rise in temperature, the material is subjected to even higher internal power dissipation. As carbon is one of the intermediate products of high-temperature decomposition by microwave reduction, and has a much higher loss factor than plastics or rubber, the higher temperature leads to even greater power dissipation within the material, leading to further molecular breakdown. Hydrogen released during the molecular breakdown and the thermal runaway phenomenon produce an intense series of exothermic reactions, until equilibrium occurs. Above equilibrium, thermodynamic control is favored.

(A) Raw Material Particle Sizing Aspects

In the case of scrap tires, the feedstock is typically in a random chunk form, a diameter or thickness, which typically varies from ½ inch (12.7 mm)×½ inch (12.7 mm) or smaller, to a maximum which does not typically exceed 2 inches (5.08 cm). This invention will also process material, which has been generated by a hammer mill, whose scrap tire material approaches 3 inches (7.62 cm) in size. The penetration depth of this material at 915 MHz is several inches, and the material retaining sides of the belt are 4 inches (10.16 cm) in height; therefore, the random raw material sizes, as provided by the scrap tire shredders and chippers, are acceptable.

An additional desirable aspect of the raw material is that the scrap tire material be subjected to a steel wire removal system. Though this step is not necessary for the proper operation of the invention, steel wire removal contributes to an additional 12-15% process efficiency for the microwave reduction system, which more than offsets the cost of the steel wire removal.

(B) Contact Time

While not a primary metric for control, the material contact time of the material within the applicator is primarily dependent on the speed of the belt, which is controlled by a variable speed motor, which in a typical application will range from 1 to 8 feet per minute (0.305-2.44 meters per minute). Increasing the contact time within the applicator will increase the types of products; i.e., gas:oil ratio and composition of the hydrocarbon vapor stream. Increasing the contact time still further will result in bond breaking, leading to decrosslinking, or depropagation or depolymerization or all three, occurring either simultaneously or sequentially, dependent on the applied microwave power density and applicator pressure.

(C) Waveguides

The waveguides are preferably low-loss divaricated waveguide assemblies which direct out-of-phase microwaves into at least one pair, preferably a matrix of eight (8) microwave diffusion assemblies per applicator, in combination with a low-loss, sealed dual-flanged waveguide isolation assembly for each microwave diffuser, a balanced waveguide configuration serving the eight inputs to each applicator and a waveguide terminator at the end of the microwave diffuser assembly, and the multi-mode applicator itself. Due to the presence of the nitrogen or argon, higher microwave power density can be applied to the applicator, as nitrogen and argon significantly raise the voltage breakdown point. Further, nitrogen and argon serve as a blanketing or purge gas within the waveguide, in the event of failure of the pressurized fused quartz, dual window assembly (although other materials such as zirconia and alumina may be used as a substitute for quartz).

(D) Microwave Frequency

Historically, the frequency of 915 MHz was not originally allocated for use in the Industrial, Scientific, and Medical (ISM) applications throughout the world, and no allocation for 915 MHz applications exist today in continental Europe. However, in the United Kingdom, 894 MHz is allocated for industrial applications, a frequency at which this invention is capable of operating. In North and South America, 915 MHz is allocated for unlimited use in industrial applications. Operation at 915 MHz is allowable in most parts of the world with proper screening and grounding to avoid interference with communications equipment.

Formerly, only low power magnetrons (<3 kW) were available for 2450 MHz use, but 15-60 kW magnetrons were available for 915 MHz use. Currently, magnetron selection from 2.2-60 kW exists at 2450 MHz, while magnetrons operating a 915 MHz are available from 10-200 kW. The preferred frequency of operation at 915 MHz for this invention was chosen primarily for increased penetration depth, increased power availability, increased operating efficiency, and longer operating life, resulting in a reduced number of magnetrons and lower cost per kilowatt of microwave output power.

(E) Tuners

The tuners are preferably either three- or four-stage tuners, preferably motor-driven with automatic feedback loops. When a manually tuned, three-stage microwave tuner assembly is employed, each tuning stub set (i.e., stubs 1 & 2 as well as sets 2 & 3) are separated by only ⅛ waveguide wavelengths. However, preferred is a four-stage automated tuner assembly. Increasing from a three-stage tuner assembly to a four-stage tuner more accurately matches the load/tuner combination, permitting the addition of automatic tuning for improved process operation. The automatic tuning assembly permits continuously-adjustable compensation to match the microwave generators to a changing load in the material within the applicator. Matching is achieved by controlling the amplitude of the reflection coefficient, while tandem or cascade movement controls the phase angle through a parameter known as susceptance. Susceptance within the waveguide section varies as the insertion depth and the selected diameter of the tuning slug, which results in controlling the amplitude of the reflection coefficient. For a four-stage tuner, stubs one and three control admittance, while stubs two and four control the conductance. Therefore, the reflection amplitude and phase angle can be varied with the tuner's adjustment range to achieve minimum net reflected power returning from the applicator. Tuning stubs 1 and 2 are separated by ¼ wavelength for optimum tuning effect. Tuning stubs 2 and 3 are separated by % waveguide wavelengths. Tuning stubs 3 and 4 are separated by ¼ waveguide wavelength. In this preferred embodiment, it is seen that there is an increased spatial distance between the first set of tuner stubs as compared to the second set of tuner stubs resulting in minimization (if not elimination) of interaction between the two sets of tuning stubs.

(F) Diffuser Assemblies

Figure 4:
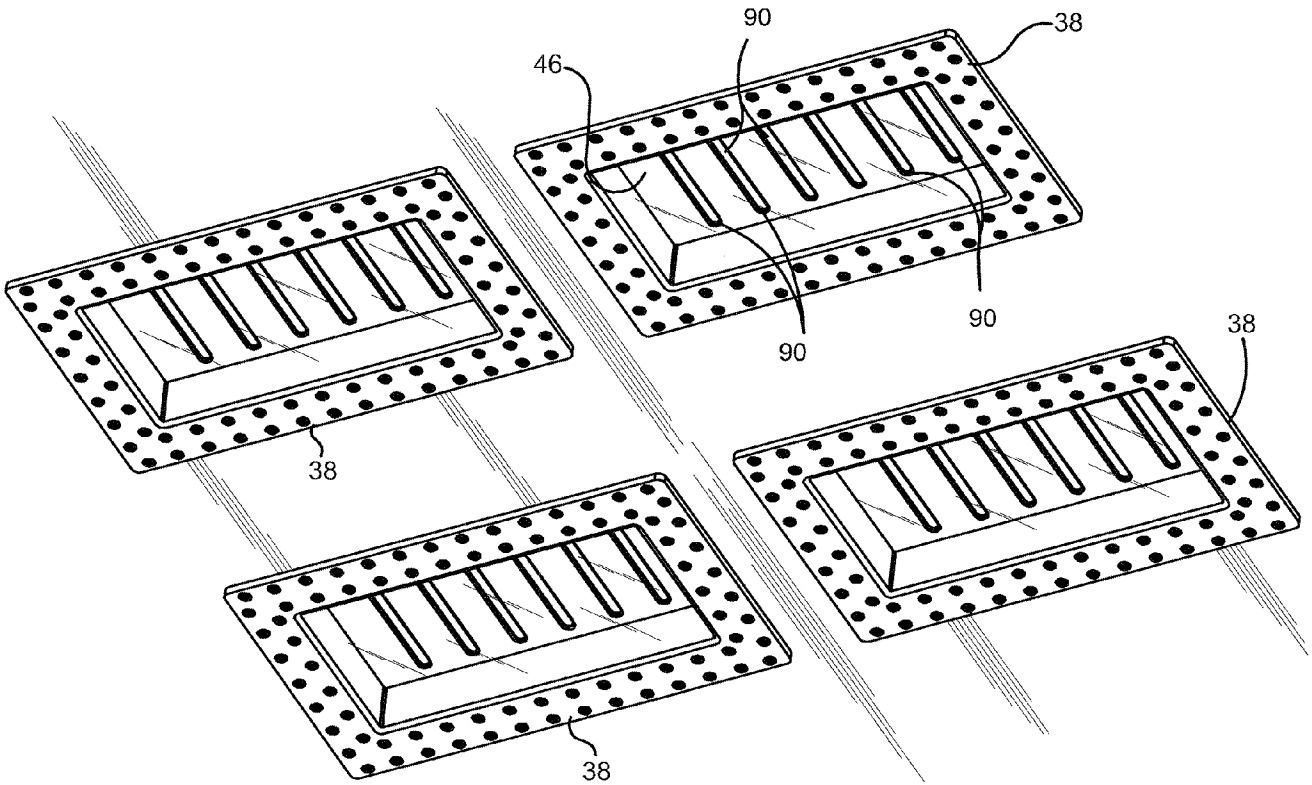
FIG. 4 is a perspective view of four applicator diffuser matrices.
Figure 5:
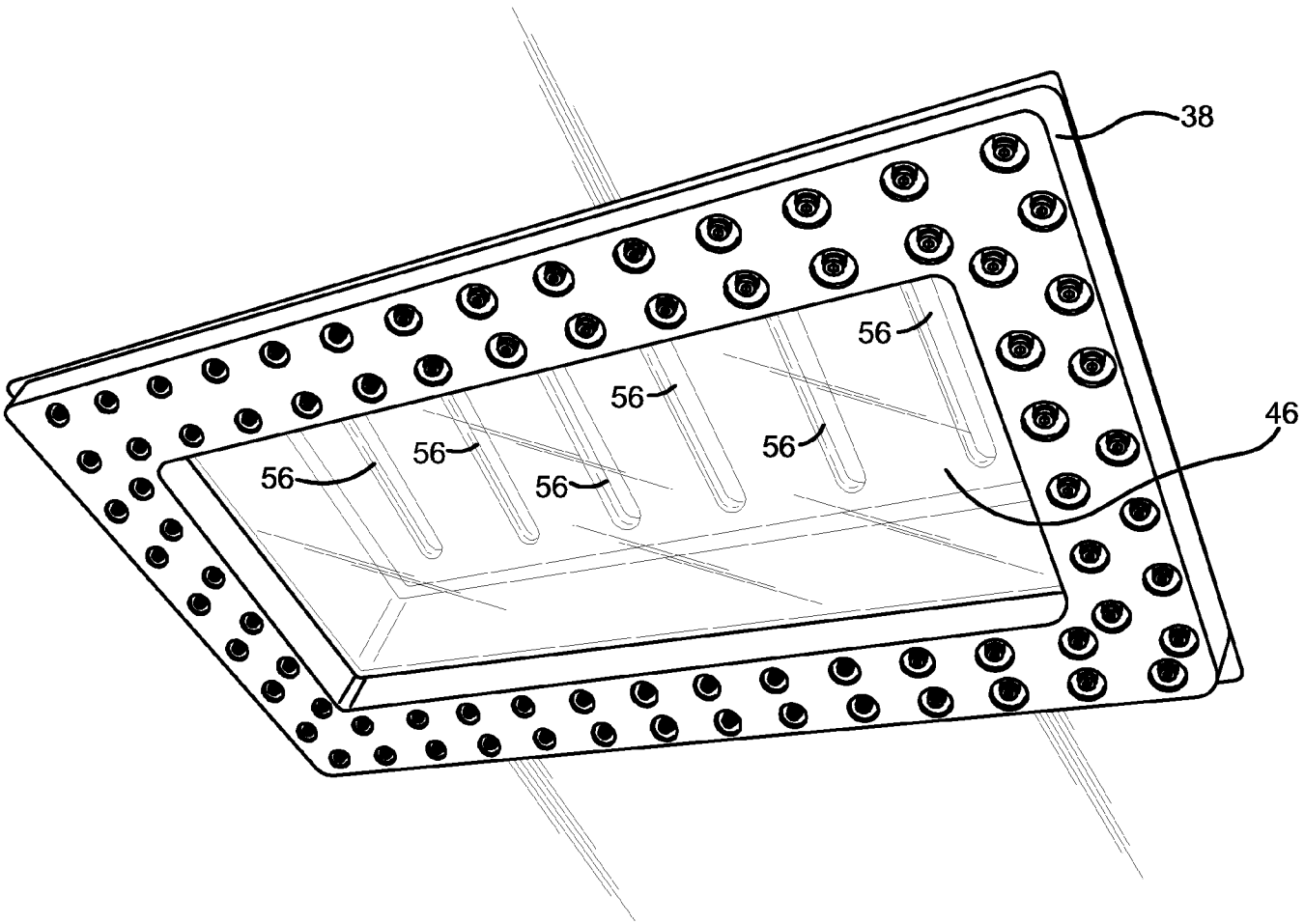
FIG. 5 is an enlarged perspective view of one applicator diffuser matrix of FIG. 4.
Figure 6A:
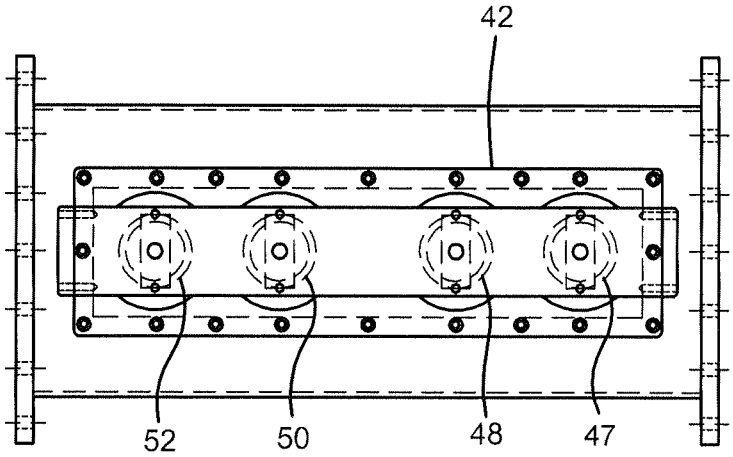
FIG. 6*a* is an enlarged side elevational view of a four-stage tuner illustrated in FIGS. 2-3.
Figure 6B:
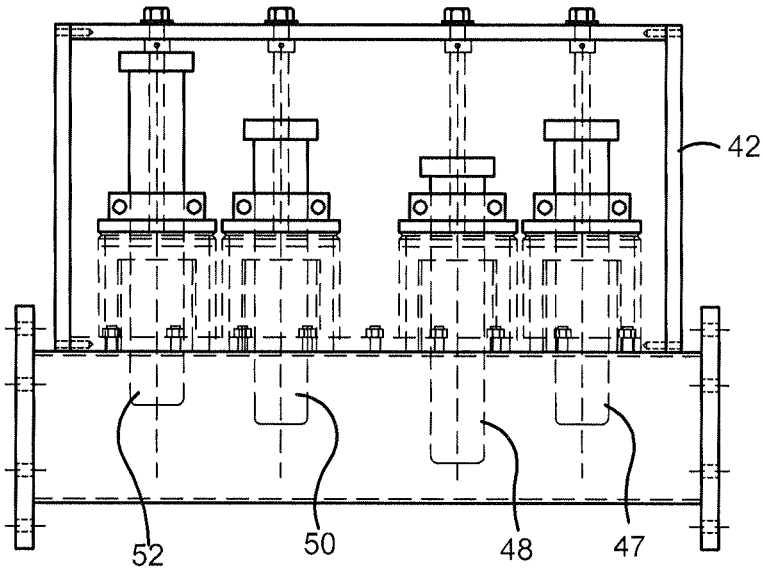
FIG. 6*b* is a bottom view of FIG. 6*a*.

The microwave diffuser matrix contributes significantly to the low reflected power, in that the maximum amount of applied power can be coupled directly into the preferred eight (8) diffuser modules per applicator through six (6) essentially parallel channels per diffuser (illustrated with four assemblies in FIG. 4 and with a single assembly in exploded form in FIG. 5), each port having a curved or curvilinear bevel for a total of forty-eight (48) applicator input channels in the diffuser matrix per applicator, with minimum losses and reflected power. The spacing between diffusor channels is between 1-2 waveguide wavelengths apart, more preferably approximately 1.5 waveguide wavelength. The spacing of each diffusor assembly is located waveguide wavelengths from each other and waveguide wavelengths to the applicator wall.

In this application, it should be noted that the number of channels per diffuser module is dependent on various factors which include applicator size, port cross-sectional area, and distance of separation between channels, to prevent arcing within diffuser channels. For a 60 kW microwave generator, four (4) channels are generally sufficient. For a 75 kW microwave generator, generally five (5) channels would be employed, while for a 100 kW microwave generator, six (6) channels would be used.

(G) Power Density Control

One improvement is a shift in the understanding that process control is accomplished by power density control, instead of temperature or power control or simply by varying the belt speed. Power density is, by definition, power applied per unit volume of material. By shifting to power density control, it is possible to eliminate hot and cold spots within the entire length of the applicator, leading to greater uniformity and increased stabilization of the operation of the system as illustrated by the use of a directional coupler system, which monitors forward and reflected power.

(III) Dual Application Mode

Figure 2:
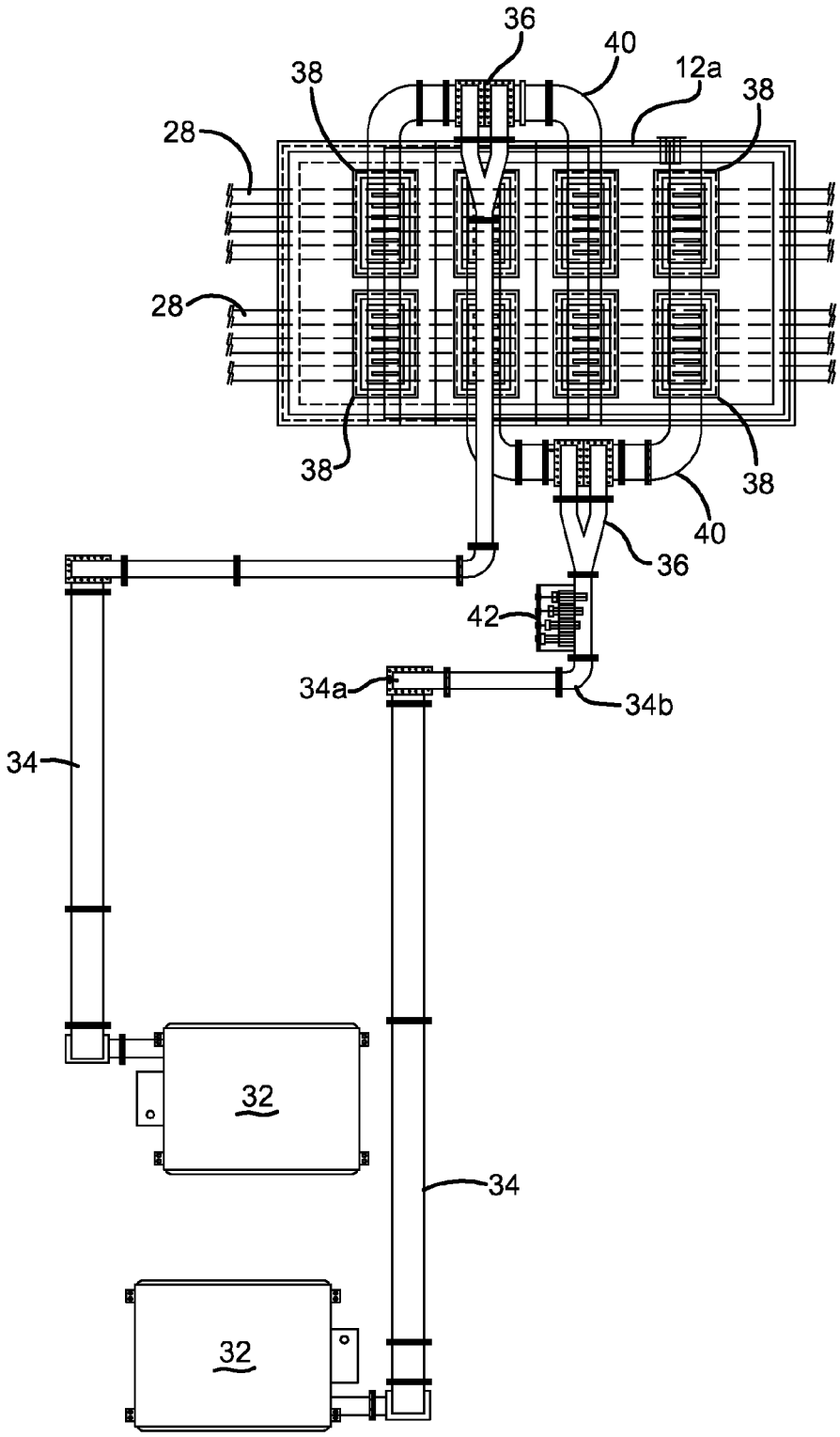
FIG. 2 is a top plan view of one of the two modules illustrated in FIG. 1 with waveguides, illustrating six microwave-transparent tubes entering and exiting the applicator assembly.
Figure 3:
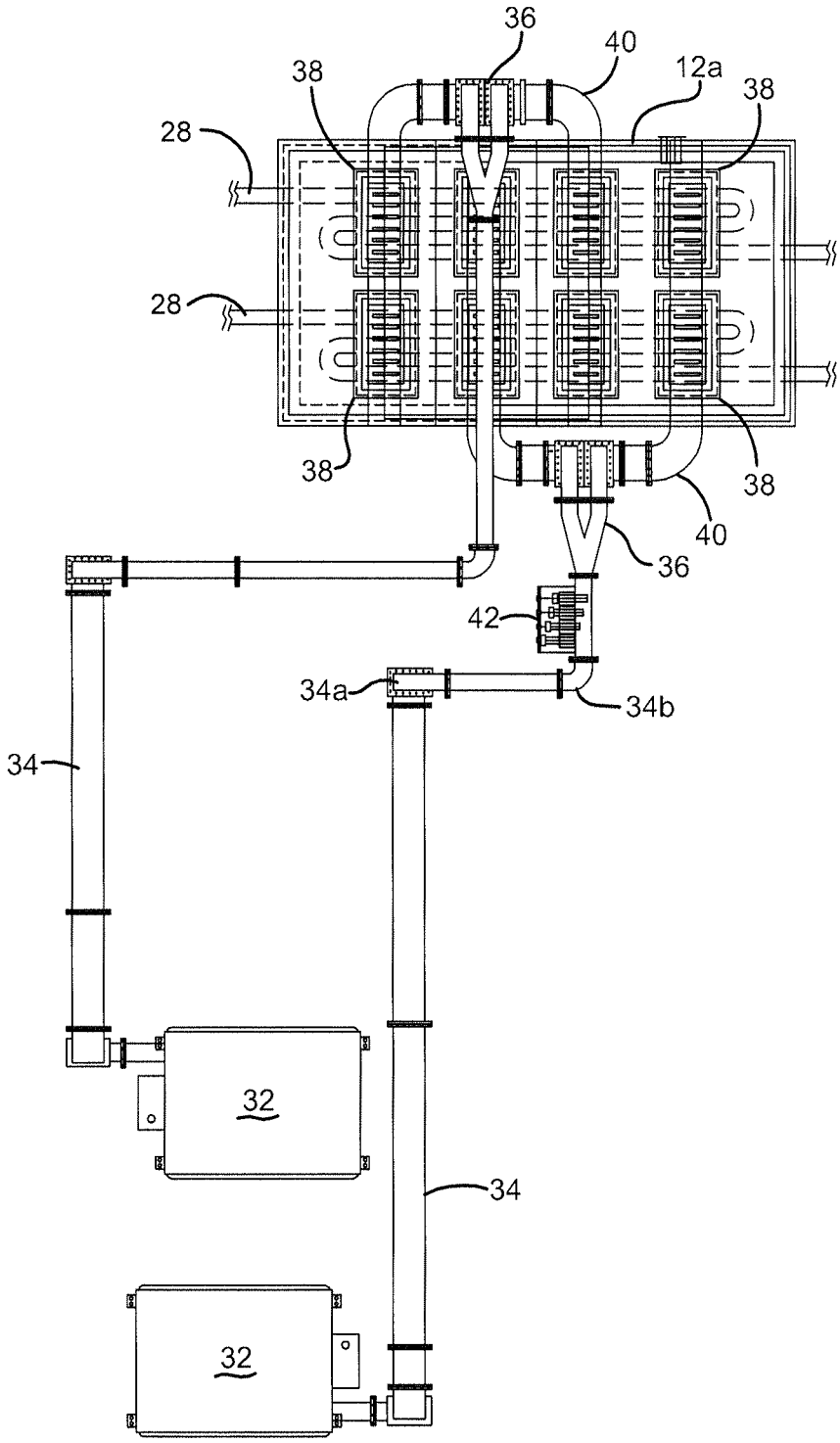
FIG. 3 is a top plan view of another embodiment of FIG. 2, with waveguides, illustrating two microwave-transparent tubes entering and exiting the applicator assembly, the tubes configured in a serpentine configuration.

The applicator of the present invention is illustrated in FIGS. 1-3 and is designed to process high volumes of liquids through ceramic pipes with diameters ranging from 2-5 (or more) inches (5.08-12.7 cm) integrated into a rectangular applicator configuration. FIG. 1 illustrates a two applicator microwave reactor 10 with at least one microwave-transparent tube 26 (only partially illustrated in the Figure, with the understanding that the preceding piping as well as subsequent piping is not illustrated) disposed through only one of the reactor applicator chambers 12*a*. The multi-module applicator assembly also includes flexible expansion joints 20 and a floating base frame assembly 22 to allow compensate for thermal expansion and contraction during startup and shutdown operations, respectively as better illustrated in FIG. 1. Microwave reduction applicator 10 has one entry port 14 with hopper feed 16 and one exit port 54, which are in longitudinal communication with a closed-mesh, continuous, stainless steel belt 18, said belt being of mesh composition, set within a pair of side guides, and having longitudinal raised sides for retention of the sample, said sides being approximately 4 inches (10.16 cm) in elevation. As illustrated, there are two access-viewing ports 24 positioned on each side of microwave reduction applicator 10. Each prior art microwave reduction applicator 12*a* or 12*b* will include at least two (2) preferably four (4) or more waveguide entry ports, depending on the specific application and the microwave power required for the application. While a total of two (2) applicators 12*a* and 12*b* are illustrated in FIG. 1, both larger and smaller numbers of applicators necessary to arrive at an application-specific chamber length, are envisioned to be within the scope of the invention. The invention will function with only one (1) applicator chamber with only two (2) entry ports.

Six (6) single pass microwave-transparent ceramic tubes 28 are illustrated in FIG. 2 positioned within one of the two microwave applicator chambers 12*a* illustrated in FIG. 1 and portray a straight-through configuration, where high volume and reduced output temperature are desired. FIG. 3 illustrates a three-pass S-configuration or synonymously serpentine configuration, where a reduced volume and a high output temperature are desired. Either configuration results in a significant improvement in material throughput. This invention allows processing of 16,965 cubic inches or 9.82 cubic feet of material with a volume ratio of only 5.2%, while allowing development of a process temperature of 750° F. (399° C.) with 400 kW of applied power.

This invention effectively shortens the lengths of waveguide, thus allowing the microwave generators and applicator to be installed in closer proximity to each other, thereby reducing resistive losses through the waveguides, whose losses manifest themselves as heat and wasted energy as well as reducing the equipment footprint. As better illustrated in FIG. 2, illustrating only one of the two (2) microwave applicators of FIG. 1, the smaller footprint is manifested by employing two (2) microwave generators 32 which feed at least one applicator 12*a*, preferably two (2) applicators, more preferably three (3) or more, although the upper limit is to be determined using sound engineering principles, one applicator being illustrated in FIGS. 2-3. Microwaves are directed from microwave generator 32 to at least one microwave applicator 12*a* by various lengths of waveguides 34, optionally in combination with low-loss 90° H-plane waveguide elbow assembly 34*a* and low-loss 90° E-plane waveguide assembly 34*b* in communication with at least a pair of low-loss divaricated waveguide assemblies 36, balanced waveguide assembly 40 to at least a pair of microwave diffuser matrices 38, more preferably four (4) diffuser matrices (shown in FIG. 4), most preferably eight (8) diffuser matrices. Each waveguide assembly/microwave generator pair propagating microwaves which are out-of-phase with respect to each other, as described previously. In at least one waveguide assembly, is positioned at least one cascaded multiple-stage microwave tuner assembly 42, more fully described below.

The microwave diffuser matrix contributes significantly to the low reflected power, in that the maximum amount of applied power can be coupled directly into the preferred eight (8) diffuser modules per applicator through six (6) essentially parallel channels 90 per diffuser (illustrated with four assemblies in FIG. 4 and with a single assembly in exploded form in FIG. 5), each port having a curved or curvilinear bevel 56, for a total of forty-eight (48) applicator input channels in the diffuser matrix per applicator, with minimum losses and reflected power. The spacing between diffusor channels is between 1-2 waveguide wavelengths apart, more preferably approximately 1.5 waveguide wavelength. The spacing of each diffusor assembly is located waveguide wavelengths from each other and waveguide wavelengths to the applicator wall.

In this application, it should be noted that the number of channels per diffuser module is dependent on various factors which include applicator size, port cross-sectional area, and distance of separation between channels, to prevent arcing within diffuser channels. For a 60 kW microwave generator, four (4) channels are generally sufficient. For a 75 kW microwave generator, generally five (5) channels would be employed, while for a 100 kW microwave generator, six (6) channels would be used.

In this aspect of the invention, a low-loss, phase-shifting, waveguide system downstream of divaricated waveguide assemblies 36 with reflector plates—i.e., low-loss "Y"-splitter, long-radius E-Plane 34*b* and H-Plane elbows 34*a*, a new waveguide material, e.g., aluminum 3003-H14 to further reduce waveguide assembly losses through improved conductivity. As illustrated at least in FIGS. 2-3, the microwave generators are offset, resulting in unequal lengths of waveguides from the microwave generators to the input of the divaricated waveguide assemblies 36. Phase delay occurs upstream of the divaricated waveguide assemblies, which introduces phase rotation of the microwave energy waveform due to the unequal waveguide lengths. The reduced length of one (1) wavelength to one-half (½) wavelength from the entrance flange of the throat, along with the reduced waveguide entrance angle from 60° to 15°, to the balanced output waveguide sections of divaricated waveguide assembly. This results in a lower loss and elimination of reflected power. The length of the output straight waveguide sections of the divaricated waveguide assembly are identical lengths from the throat to the output flanges for balanced output presented to the new waveguide configuration to the application. All E-Plane and H-Plane elbows are of a long-radius design to reduce waveguide losses and reflected power throughout the relatively long distance from the microwave generators to the applicator input. The reflector plate at the end of the waveguide assembly provides an effective short circuit to stop further propagation of the microwave energy waveform. If the microwave energy is not diffused through the diffuser channels, reflected power will result. Proper adjustment of the multi-stage microwave tuner assembly will allow matching of the microwave generator output to the load or material within the applicator, resulting in elimination of reflected power.

In one aspect of the invention, a manually tuned, three-stage microwave tuner assembly may be employed in which each tuning stub set (i.e., stubs 1 & 2 as well as sets 2 & 3) are separated by only % waveguide wavelengths. However, preferred is a four-stage automated tuner assembly. In a most preferred embodiment, the tuning stubs are motor-driven with individual feedback loops to the Programmable Logic Controller (PLC) in the Main Control Panel. Increasing from a three-stage tuner assembly to a four-stage tuner more accurately matches the load/tuner combination, permitting the addition of automatic tuning for improved process operation. The automatic tuning assembly permits continuously-adjustable compensation to match the microwave generators to a changing load in the material within the applicator. Matching is achieved by controlling the amplitude of the reflection coefficient, while tandem or cascade movement controls the phase angle through a parameter known as susceptance. Susceptance within the waveguide section varies as the insertion depth and the selected diameter of the tuning slug, which results in controlling the amplitude of the reflection coefficient. For a four-stage tuner 42, stubs one 47 and three 50 control admittance, while stubs two 48 and four 52 control the conductance. Therefore, the reflection amplitude and phase angle can be varied with the tuner's adjustment range to achieve minimum net reflected power returning from the applicator. Tuning stubs 47 and 48 are separated by ¼ wavelength for optimum tuning effect. Tuning stubs 48 and 50 are separated by % waveguide wavelengths. Tuning stubs 50 and 52 are separated by ¼ waveguide wavelength. In this preferred embodiment, it is seen that there is an increased spatial distance between the first set of tuner stubs 47, 48 as compared to the second set of tuner stubs 50, 52, resulting in minimization (if not elimination) of interaction between the two sets of tuning stubs.

Low-loss divaricated waveguide assembly 36 directs microwaves to at least one, preferably a dual matrix of eight (8) microwave diffusion assemblies 38, a low-loss, sealed dual-flanged waveguide isolation assembly for each microwave diffuser, a balanced waveguide configuration 40 serving the eight inputs to each applicator 12 and a waveguide terminator at the end of the microwave diffuser assembly, and the multi-mode applicator itself.

The use of low-loss components provides less resistance in the waveguide assembly, leading to reduced reflected power, resulting in higher transfer of microwave energy from the microwave generators to the applicator. The typical reflected power in a conventional waveguide design at a power level of only 75 kW is approximately 6% or 4.5 kW. The measured reflected power in this invention operating at full power of 200 kW per applicator module, with the low-loss waveguide design, and all of the other low-loss enhancements is less than 0.1% or 1 kW max.

The microwave diffuser matrix contributes significantly to the low reflected power, in that the maximum amount of applied power can be coupled directly into the eight (8) diffuser modules per applicator through six (6) channels 90 per diffuser (illustrated with four assemblies in FIG. 4 and in exploded form in FIG. 5), each port having a curved (rounded) or radiused or curvilinear bevel 56, for a total of forty-eight (48) essentially parallel, applicator input channels in the diffuser matrix, with minimum losses and reflected power. Each channel is separated by a spacing equivalent to between 1-2 waveguide wavelengths, more preferably about 1.5 waveguide wavelength, each channel having no sharp contour edges. By this contour edge limitation, it is meant that the planar intersection does not approximate 90°.

In this application, it should be noted that the number of channels per diffuser module is dependent on various factors which include applicator size, port cross-sectional area, and distance of separation between channels, to prevent arcing within diffuser channels. For a 60 kW microwave generator, four (4) channels are generally sufficient. For a 75 kW microwave generator, generally five (5) channels would be employed, while for a 100 kW microwave generator, six (6) channels would be used.

As a guide to the above, it is noted that for an applicator which has eight (8) diffuser matrices, each with 4-channel diffusor/applicator=60 kW (120 kW total) dissipation per applicator, 10 feet (304.8 cm) in overall length, 4 feet (121.9 cm) wide and with an active height of 36 inches (91.4 cm). The channels may be widened, observing the applied microwave power to conform to the power density requirements of the channels, relative to the maximum input to the WR-975 waveguide.

For an applicator which has eight (8) diffuser matrices, each with 5-channel diffusor/applicator=75 kW (150 kW total) dissipation per applicator, 10 feet (304.8 cm) in overall length, 4 feet (121.9 cm) wide and with an active height of 39 inches (99.1 cm). The channels may be widened, observing the applied microwave power to conform to the power density requirements of the channels, relative to the maximum input to the WR-975 waveguide.

For an applicator which has eight (8) diffuser matrices, each with 6-channel diffusor/applicator=100 kW (200 kW total) dissipation per applicator, 12 feet (365.8 cm) in overall length, 4 feet (121.9 cm) wide, with an active height of 42 inches (106.7 cm).

The low-loss purged, sealed, dual-flanged waveguide isolation assembly between the microwave diffuser and the applicator input port contains two low-loss, dielectric wafers ⅜ inch (0.95 cm) thick with a low coefficient of thermal expansion to re-establish the focal point of the guided microwave wavepoint in the center of the waveguide. The dielectric wafers are inset within the flanges and connected by a quarter-wavelength long section of waveguide. The dielectric wafers were chosen according to the following criteria:

(1) minimum impedance to the incoming waveform or maximum input admittance and propagation constant compensate for the permittivity of the wafer material in order to avoid dielectric heating; (2) minimum coefficient of thermal expansion to permit high differential temperatures on opposite sides of the assembly; and (3) minimum index of refraction for the incoming waveform to minimize refocusing efforts in accordance with Snell's law and the Brewster angle, relative to angles of incidence and reflection. Each wafer contains a conductive carbon gasket in a picture-frame configuration, to provide a conductive path from the waveguide to the flanges. The waveguide isolation assembly is nitrogen-filled to maintain an inert, non-flammable atmosphere within the assembly in the event of a failure of either wafer. The combined effects of the above results in maximum energy transfer of the microwave waveform into the applicator, while providing total isolation between the applicator and the generator. This is an important consideration when the applicator contains flammable or explosive gases.

Each microwave chamber is insulated and double-walled. The applicator is a sealed, purged low-loss (high-conductivity) seamless aluminum cavity to reduce wall losses, plus the capability to operate at a maximum internal temperature of approximately 752° F. (400° C.). The temperature rating increases to 1500° F. (816° C.) when the applicator described in this invention is fabricated from Stainless Steel, Type 304. The multi-module applicator assembly also includes flexible expansion joints 20 and a floating base frame assembly 22 to allow compensate for thermal expansion and contraction during startup and shutdown operations, respectively as better illustrated in FIG. 1.

The cumulative effect of these improvements represents significant improvements in microwave efficiency, temperature distribution within the applicator assembly, and reduced energy consumption for materials processing, and total isolation of the process gases from the highly energetic atmosphere within the microwave generator. It is important to note that the combination of 4-stage tuner assembly 42, dual pressure window assembly 38 with nitrogen purge and quartz window 46, microwave diffuser assembly 90, beveled microwave diffuser matrix 56, and the microwave applicator waveguide geometry, namely the pair of divaricated waveguides are what form at least a portion of the improvement described in this invention.

Although all of the above contribute to significant improvements in efficiency and resulting increase in processed material (throughput), without being held to any one theory of operation, it is believed that the microwave diffuser matrix 38, consisting of eight (8) microwave diffusers, and the nitrogen-purged dual pressure window assemblies (preferably using quartz, zirconia or alumina windows), contribute a significant improvement to the invention.

However, for the ability to process various and different materials in this system, it should be recognized that the 4-stage tuner system allows a proper match between the microwave generator(s) and the material being processed (load). In this manner, the same product is capable of processing virtually any of the solid hydrocarbon materials we have identified; i.e., scrap tires, mixed plastics, automobile shredder residue (ASR), roofing shingles, construction/demolition waste, medical waste, municipal solid waste (MSW), and PCB/PAC/HCB-laden or fuel-laden soils and aggregates within the same applicator unit.

In general for the liquids processing aspect of this invention, microwave energy is produced by a microwave generator and coupled through waveguides, through either a 3-stage or 4-stage stub tuner toward a dummy load or reflector plate.

Prior to startup of the system, process isolation valves remain closed after the preceding shutdown. A nitrogen generator supplies nitrogen through a solenoid valve and a check valve in a purge and pressurize sequence. With the vent valve closed, nitrogen initially pressurizes the system. Upon pressurization, the vent valve is opened and nitrogen, along with any displaced air, flows out the vent valve until five volumes of purge gas have been completed. Nitrogen continues to flow at a reduced rate to reduce the Btu valve of the recovered gas to levels acceptable to the prime mover. Upon shutdown and after the temperature decreases to less than 100° F. (37.78° C.), the process isolation valves are closed.

Although this invention is illustrated in a stationary configuration, it may be readily converted to a mobile configuration for transport to various processing locations.

In summary, this invention provides a means to process 113 times the volume of material, achieve 2.5 times the temperature, and apply 4 times the power within the same applicator as the invention described in U.S. patent application Ser. No. 12/962,407 resulting in a more efficient method of heating and subsequently reducing large volumes of highly-viscous fluids to more usable byproducts.

Another embodiment of this invention includes simultaneous processing of both liquid and solid materials due to the presence of both ceramic tubes and a stainless steel mesh conveyor belt. In that respect this invention could be referred to as a hybrid system, combining the best of both liquid and solid microwave processing methods. The liquids flow through the microwave-transparent ceramic tubes, mounted approximately one third of the distance below the top of the active area within the applicator, while the solids are conveyed continuously through the applicator.

The total amount of material includes the total sum of the mass flow of both of the liquid and solid materials, in order to maintain the operation with the maximum power density. The proportions of the liquid to solid materials are infinitely variable in either direction, as long as the maximum material exposed to the high power density microwave energy does not exceed the power absorption capability of the materials. The applicator throughputs, liquid and solid, are independently regulated by the flow of the materials.

Control of the flow of the liquid material is measured volumetrically in gallons per hour, corresponding to a mass flow of pounds per minute throughput. Control of the volumetric flow of solid material is measured in feet per minute, based on a material density specified in pounds per cubic feet, which corresponds to a mass flow of pounds per minute throughput.

The independent flows of liquid and solid materials may be continuously adjusted during operation, as needed, in order to achieve the desired results in the byproducts. For example, the liquids may be vaporized, while the solids are molecularly reduced. However, the total mass flow of both materials presented as a load to the applied high power density microwave energy within the applicator, must be maintained within the specified limits of the total continuous capability of two microwave generators. In the hybrid mode of operation, the preferred continuous capability of two microwave generators is 100 kW each, but the invention is not necessarily limited to this value, as higher and lower values are within the scope of the invention as chosen using sound engineering judgment. The total amount of liquid flow and solid flow is based on the dielectric properties and the microwave absorption characteristics of the materials. A single module hybrid-type applicator in conjunction with two 100 kW microwave generators is capable of simultaneously processing 2.5 gal/min (9.46 L/min) of crude oil and 800 lbs/hr (362.87 Kg/hr) of shredded scrap tire material.

The best mode for carrying out the invention has been described for the purposes of illustrating the best mode as well as alternative embodiments, known to the applicant at the time of the filing of this patent application. The examples are illustrative only and not meant to limit the invention, as measured by the scope and spirit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof.

What is claimed is:

1. A process for simultaneously degrading both a liquid and a solid organic-containing feedstock comprising the steps of: supplying a liquid feedstock through a liquid flow meter horizontally into a microwave-transparent ceramic tube; controlling an amount of said liquid feedstock fed into at least one microwave chamber through said microwave-transparent ceramic tube; supplying a solid feedstock through an entry port in longitudinal communication with a closed- mesh, continuous, metal conveyor belt; simultaneously and independently with said step of controlling an amount of liquid feedstock fed into said at least one microwave chamber, controlling an amount of solid feedstock fed horizontally into said at least one microwave chamber on said closed-mesh metal conveyor belt; simultaneously exposing said liquid and solid feedstock to at least two sources of microwaves operating at a center frequency of 915 MHz which are out-of-phase with respect to each other, said step of exposing being non-pyrolytic and requiring no externally-applied heat; transmitting said at least two sources of microwaves through waveguides and entering said at least one microwave chamber through at least two quartz pressure window assemblies each having two flanges separated by one wavelength of waveguide and into respective microwave entry ports, each of said microwave entry ports comprise a diffuser matrix after said quartz pressure window assemblies, said matrix comprising at least four essentially parallel beveled entry channels, said matrix providing microwaves for use in degrading both said liquid feedstock in said microwave-transparent ceramic tube and said solid feedstock on said conveyor belt; and wherein a total amount of both said liquid and solid feedstock is controlled to maintain maximum power density within said at least one microwave chamber by use of a directional coupler system which monitors forward and reflected microwave power.

2. The process of claim 1 wherein a ratio of liquid to solid feedstock is infinitely variable provided that said power density does not exceed a power absorption capability of said materials.

3. The process of claim 1 wherein a total mass flow of both materials presented as a load to the applied high power density microwave energy within said at least one microwave chamber is maintained within a specified limit of a total continuous capability of said microwave generators.

4. The process of claim 1 which further comprises the step of adjusting a microwave frequency by a three-stage or a four-stage tuner assembly within at least one waveguide.

5. The process of claim 1 which further comprises the step of adding at least one inert gas.

6. The process of claim 5 wherein said at least one inert gas is selected from the group consisting of argon and nitrogen.

7. The process of claim 6 wherein a spacing between diffusor channels is between 1-2 wavelengths in distance apart.

8. The process of claim 7 wherein said spacing is approximately 1.5 wavelengths in distance.

9. The process of claim 1 wherein said microwaves are out-of-phase by approximately 90°.

10. The process of claim 1 wherein said step of transmitting comprises transmitting through at least six beveled entry channels.

* * * * *